US010591247B2

(12) United States Patent
Hubbell et al.

(10) Patent No.: US 10,591,247 B2
(45) Date of Patent: Mar. 17, 2020

(54) HANDGUARD ATTACHMENT ASSEMBLY FOR A FIRARM

(71) Applicant: Sig Sauer, Inc., Newington, NH (US)

(72) Inventors: Reed Hubbell, Newmarket, NH (US); William C. Daley, Jr., Suffield, CT (US); Harry Andrew Packard, Amesbury, MA (US); David B. Hopkins, Exeter, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 16/253,166

(22) Filed: Jan. 21, 2019

(65) Prior Publication Data

US 2019/0226799 A1 Jul. 25, 2019

Related U.S. Application Data

(60) Provisional application No. 62/619,759, filed on Jan. 20, 2018.

(51) Int. Cl.

| | |
|---|---|
| ***F41C 23/16*** | (2006.01) |
| ***F41G 11/00*** | (2006.01) |
| ***F41C 27/00*** | (2006.01) |

(52) U.S. Cl.

CPC ..... *F41C 23/16* (2013.01); *F41C 27/00* (2013.01); *F41G 11/004* (2013.01)

(58) Field of Classification Search

CPC ..... F41A 21/44; F41C 23/16; F41C 23/00

See application file for complete search history.

(56) References Cited

U.S. PATENT DOCUMENTS

| | | | | |
|---|---|---|---|---|
| 2,685,754 | A | 8/1954 | Crittendon et al. | |
| 5,412,895 | A | 5/1995 | Krieger | |
| 6,499,245 | B1 | 12/2002 | Swan | |
| 6,671,990 | B1 | 1/2004 | Booth | |
| RE39,465 | E | 1/2007 | Swan | |
| 7,458,179 | B2 | 12/2008 | Swan | |
| 7,716,865 | B2 | 5/2010 | Daniel et al. | |
| 7,770,317 | B1 | 8/2010 | Tankersley | |
| 8,141,289 | B2 | 3/2012 | Gomez et al. | |
| 8,251,051 | B2 | 8/2012 | Maggiore | |
| 8,276,303 | B2 | 10/2012 | Kapusta et al. | |
| 8,347,540 | B2 * | 1/2013 | Sirois | F41C 23/16 42/71.01 |
| 8,453,364 | B2 | 6/2013 | Kucynko | |
| 8,726,558 | B1 * | 5/2014 | Nason | F41C 23/16 42/71.01 |

(Continued)

*Primary Examiner* — Derrick R Morgan

(74) *Attorney, Agent, or Firm* — Finch & Maloney PLLC

(57) ABSTRACT

A handguard attachment assembly for a firearm is disclosed. The assembly includes a handguard with an elongate structure extending between a first end and a second end, where the handguard has at least one opening proximate the first end. A flange insert is received in an opening on a first side of the handguard and engages the handguard. A fastener secures the flange insert to a connector positioned over the barrel nut. The fastener can be tightened to draw the handguard to the barrel nut. The connector can be a bridge connector positioned on or over the barrel nut within the handguard, or can be a connector with a flange portion that engages the second side of the handguard and has a connector body that extends towards the flange insert on the first side, to name a few examples.

26 Claims, 22 Drawing Sheets

(56) References Cited

U.S. PATENT DOCUMENTS

| | | | | |
|---|---|---|---|---|
| 8,726,559 | B1 * | 5/2014 | Mueller | F41A 21/482 42/75.02 |
| 8,782,943 | B2 | 7/2014 | Jarboe | |
| 8,904,691 | B1 * | 12/2014 | Kincel | F41C 23/16 42/71.01 |
| 9,140,506 | B2 | 9/2015 | Gomez | |
| 9,322,609 | B2 | 4/2016 | Davies | |
| 9,389,043 | B1 * | 7/2016 | Zhang | F41C 23/16 |
| 9,423,194 | B2 | 8/2016 | Fritz et al. | |
| 9,464,866 | B1 * | 10/2016 | Liang | F41C 23/16 |
| 9,476,672 | B2 | 10/2016 | Wells et al. | |
| 9,995,557 | B2 * | 6/2018 | Geissele | F41C 23/02 |
| 10,126,095 | B1 * | 11/2018 | Reid | F41C 23/16 |
| 10,145,648 | B1 * | 12/2018 | Holder | F41C 23/16 |
| 10,295,304 | B1 * | 5/2019 | Kincel | F41C 23/16 |
| 10,309,747 | B2 * | 6/2019 | Samson | F41C 23/16 |
| 10,401,122 | B2 * | 9/2019 | Williams | F41G 11/003 |
| 2003/0230022 | A1 | 12/2003 | Battaglia | |
| 2004/0049964 | A1 | 3/2004 | Vais | |
| 2006/0065112 | A1 | 3/2006 | Kuczynko et al. | |
| 2007/0017139 | A1 | 1/2007 | Larue | |
| 2007/0261285 | A1 * | 11/2007 | Troy | F41C 23/16 42/75.03 |
| 2010/0095575 | A1 | 4/2010 | Swan | |
| 2011/0126443 | A1 * | 6/2011 | Sirois | F41C 23/16 42/90 |
| 2011/0192066 | A1 * | 8/2011 | Kimmel | F41C 23/16 42/71.01 |
| 2011/0247254 | A1 | 10/2011 | Barnes | |
| 2012/0324775 | A1 | 12/2012 | Troy et al. | |
| 2013/0180151 | A1 | 7/2013 | Moore | |
| 2014/0075817 | A1 | 3/2014 | Gomez | |
| 2016/0025120 | A1 * | 1/2016 | Swan | F41G 11/003 248/231.31 |
| 2016/0054096 | A1 | 2/2016 | Dzwill | |
| 2016/0169617 | A1 * | 6/2016 | Daley, Jr. | F41C 23/16 42/71.01 |
| 2016/0195350 | A1 | 7/2016 | Packard et al. | |
| 2017/0097207 | A1 * | 4/2017 | Hines | F41C 23/16 |
| 2018/0202757 | A1 * | 7/2018 | Samson | F41C 23/16 |
| 2018/0306551 | A1 * | 10/2018 | Reid | F41C 23/16 |
| 2019/0101355 | A1 * | 4/2019 | Hubbell | F41C 23/16 |
| 2019/0154396 | A1 * | 5/2019 | Zinsner | F41A 11/04 |
| 2019/0226799 | A1 | 7/2019 | Hubbell et al. | |

* cited by examiner

HANDGUARD ATTACHMENT ASSEMBLY FOR A FIRARM

RELATED APPLICATIONS

This application claims priority under 35 U.S.C. § 119(e) to U.S. Provisional Patent Application No. 62/619,759 titled HANDGUARD CLAMP ATTACHMENT SYSTEM FOR A FIREARM and filed on Jan. 20, 2018, the contents of which are incorporated herein by reference in its entirety.

FIELD OF THE DISCLOSURE

This disclosure relates generally to firearms, and more particularly to a handguard attachment assembly for a firearm.

BACKGROUND

A handguard is a device attached to the front of a firearm to grip the weapon from the front. The handguard protects the user from the barrel, which may become very hot when firing. The handguard may also provide room for attachments to the weapon itself, such as forward grips, lights, aiming devices, bipods, grenade launchers, and other accessories. Handguards can be made from a variety of materials, including metals, such as steel (carbon and stainless), aluminum, titanium, or magnesium, and polymeric materials, such as polymers reinforced with carbon or glass, to name a few.

SUMMARY

Aspects of the present disclosure include a handguard attachment assembly for a firearm, a clamp for use with a handguard assembly, a firearm upper receiver assembly, a firearm including a handguard assembly, and methods of attaching a handguard to a firearm. In one example embodiment, a handguard attachment assembly for a firearm includes a handguard with an elongate structure extending between a first end and a second end, where the handguard has at least one opening proximate the first end. The handguard can be perforated and may have a generally tubular shape, for example. The proximal end portion of the handguard is configured to be installed over and drawn to the barrel nut when installed on the firearm, for example. A flange insert is received in an opening in a first side of the proximal end portion of the handguard. Part of the flange insert engages an outside the handguard. In its installed configuration, a fastener extends between and connects the flange insert to a connector positioned over the barrel nut. In one embodiment, the connector can be a bridge connector positioned on or over the barrel nut within the handguard proximal end portion. In another embodiment, the connector can include a flange portion that engages the second side of the handguard, and a connector body that extends towards the flange insert on the first side, for example. The fastener can be tightened to draw the handguard to the barrel nut, thereby securing the handguard to the upper receiver. Numerous embodiments and variations will be apparent in light of the present disclosure.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

BRIEF DESCRIPTION OF THE DRAWINGS

The accompanying drawings are not intended to be drawn to scale. For purposes of clarity, not every component may be labeled in every drawing.

Figure 1:
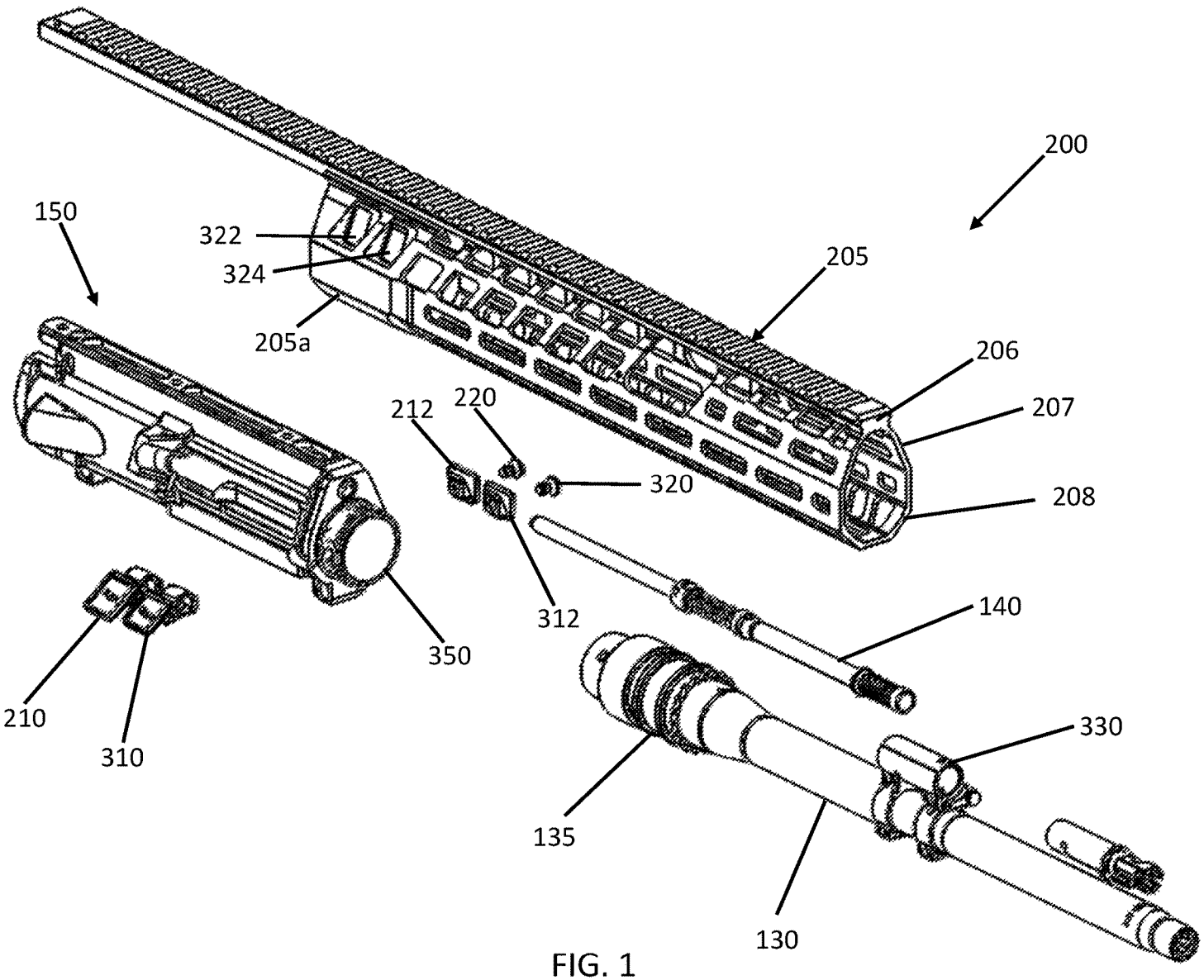
FIG. 1 illustrates an exploded view of an example handguard assembly and part of a firearm, showing the handguard, the upper receiver, the barrel assembly including barrel nut and gas block, the clamps, the fasteners for the clamps, and the operating rod, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

The present disclosure is directed to a handguard attachment system for a firearm. Some, not all, existing handguard systems are attached to the firearm using fasteners that are positioned above the barrel nut of the firearm and extend horizontally through the rifle perpendicular to the bore. The barrel nut is threaded onto the upper receiver to mount the barrel and to provide a mounting surface for the handguard. In some such systems, the barrel nut typically includes a groove around the outside diameter, forward or distally of the threaded portion of the barrel nut. Fasteners extend to engage the groove to secure the handguard system to the firearm. The fasteners are threaded through complementary holes in the handguard, in some instances with accompanying hardware. In these handguards, the position of the fasteners can interfere with the placement and operation of some components of rifles, such as the gas tube or operational rod of semiautomatic rifles and the like. Other types of handguard systems use fasteners positioned below the barrel nut of the firearm to pinch together a slot in the handguard to thereby clamp the handguard to the barrel nut. These fasteners can interfere with a user's grip and increase discomfort for the user when gripping the rear of the handguard. These systems also lack cosmetic appeal. Additionally, the clamping action of the handguard around the barrel nut can become ineffective after multiple installations of the handguard, due to stretch or fatigue of the metal of the handguard, which is typically aluminum.

Thus, a need exists for improvements to handguard attachment systems for rifles, such as semiautomatic and automatic rifles. In accordance with one or more embodiments of the present disclosure, a handguard can be attached to a firearm upper receiver without interference with the gas system, operating rod, or other components. Such a system is light weight and provides a one-piece handguard with a tubular shape. An advantage of some such handguards is having significant cost reduction over two-piece handguards.

The firearm can include an upper receiver, a barrel, a gas block, and an operating rod extending rearward from the gas block along the barrel, for example. In accordance with one embodiment, a handguard assembly for attachment to a firearm includes a handguard, one or more clamps that each include a first clamp portion and a second clamp portion, and a fastener that secures together the first clamp portion and the second clamp portion when the handguard is installed on the firearm. The first clamp portion extends through an opening in the handguard and defines a clearance opening for the operating rod (or gas tube, when present) of the firearm, thereby avoiding interference with operation of the operating rod. The handguard assembly can similarly be implemented on a firearm that does not include the operating rod or other similarly positioned feature. In an embodiment, the fastener can be a screw, and the first clamp portion can include a threaded portion for receiving the screw to secure the first clamp portion together with the second clamp portion. The handguard can be readily and easily installed on (and removed from) the firearm by the clamp(s), as will be appreciated in light of the present disclosure.

In accordance with another embodiment of the present disclosure, a handguard assembly for attachment to a firearm includes a handguard having a first opening and a second opening on opposite sides of the handguard. The handguard assembly includes a first flange that interfaces with the first opening and a second flange that interfaces with the second opening. The handguard assembly also includes a connector that interfaces with a barrel nut of the firearm. For example, the connector is positioned on top of the barrel nut within the proximal end portion of the handguard. A first fastener secures the first flange to the connector and a second fastener secures the second flange to the connector. The connector includes a cavity or opening such that, when the firearm has an operating rod, the cavity provides clearance sufficient for the operating rod to pass therethrough. It will be appreciated in light of the present disclosure that the handguard assembly can likewise be implemented on a firearm with a gas tube or on a firearm that does not have an operating rod or other similarly positioned feature.

Handguard Assembly

FIG. 1 illustrates an exploded view of a handguard assembly 200 configured to be attached to a firearm, in accordance with an embodiment of the present disclosure. In one example, the firearm includes an upper receiver 150 with an upper receiver connector 350; a barrel assembly that includes a barrel 130, barrel nut 135, and gas block 330 on the barrel 130; and an operating rod 140. The barrel 130 can be secured to the upper receiver 150 by threading the barrel nut 135 into the upper receiver connector 350, for example. For example, the proximal end of the barrel 130 is received in the upper receiver connector 350 and is secured to the receiver 150 by threading the barrel nut 135 onto the upper receiver connector 350.

The operating rod 140 extends between the gas block 330 and the upper receiver 130 when assembled. The barrel assembly shown in FIG. 1 has an operating rod 140 configured as a gas piston. Upon discharging the firearm, gas pressure inside the barrel 130 actuates the operating rod 140 via the gas block 330 and cycles the action to load the next cartridge into the chamber, for example. The gas block 330 directs pressurized gas from the barrel 130 to actuate the operating rod 140 to cycle the action. Depending upon the firearm, gas can either directly operate the action of the firearm (e.g., direct impingement), or can drive the operating rod 140 or another component of the firearm.

In one embodiment, the handguard assembly 200 includes a handguard 205 and clamps that include first clamp portions 210, 310, second clamp portions 212, 312, and fasteners 220, 320. The components of both clamps are shown, with the first clamp including a first clamp portion 210, a second clamp portion 212, and fastener 220. A second clamp is also shown, including a first clamp portion 310, a second clamp portion 312, and a fastener 320.

The handguard 205 defines a first opening 322 on a first side of the handguard, which receives the first clamp portion 210, and a second opening (not visible in FIG. 3), which receives the second clamp portion 212. The first opening 322 and the second opening are aligned along a common axis so that the first clamp portion 210 and the second clamp portion 212 can be inserted from the opposite sides of the handguard 205 and joined together by fastener 220. More specifically, the first clamp portion 210 can be inserted into the first opening 322 and the second clamp portion 212 can be inserted through the second opening and secured by fastener 220 through the second opening. In some embodiments, the handguard 205 includes a third opening 324 on the first side of the handguard, which receives the first clamp portion 310 of the second clamp, and a fourth opening (not visible in FIG. 3) on the second side of the handguard 205, which receives the second clamp portion 312 of the second clamp. The third opening 324 and the fourth opening are similarly aligned along a common axis so that the first clamp portion 310 and the second clamp portion 312 can be inserted from the opposite sides of the handguard 205 and joined together by fastener 320. More specifically, the first clamp portion 310 can be inserted into the third opening 324 and the second clamp portion 312 can be inserted through the fourth opening and secured by fastener 320 through the fourth opening.

The handguard 205 can be a unitary, one-piece handguard. In one embodiment, the handguard 205 has a generally tubular shape configured to extend over the barrel assembly and operating rod 140. The proximal end portion 205*a* of the handguard 205 is shaped and constructed to interface with the barrel nut 135 and/or the upper receiver connector 350. For example, when the barrel nut 135 has female threads to engage male threads on the upper receiver connector 350, the lower portion 208 of the proximal end portion 205*a* engages the barrel nut connector 135 when installed on the firearm and need not engage the receiver or the barrel. In other embodiments, for example, the barrel nut 135 is received in the upper receiver connector 350 and the handguard 205 engages the outer surface of the upper receiver connector 350 when installed on the firearm. The handguard can include a mounting rail 206 extending along a top of the handguard. For example, the rail 206 is a Picatinny rail (MIL-STD-1913 rail) that may extend proximally beyond the proximal end of the handguard 205 and along the top of the upper receiver 150 when installed on the firearm. The handguard 205 can be slid on and off the upper receiver connector 350 without interference from the gas block 330 or the barrel 130.

Figure 2:
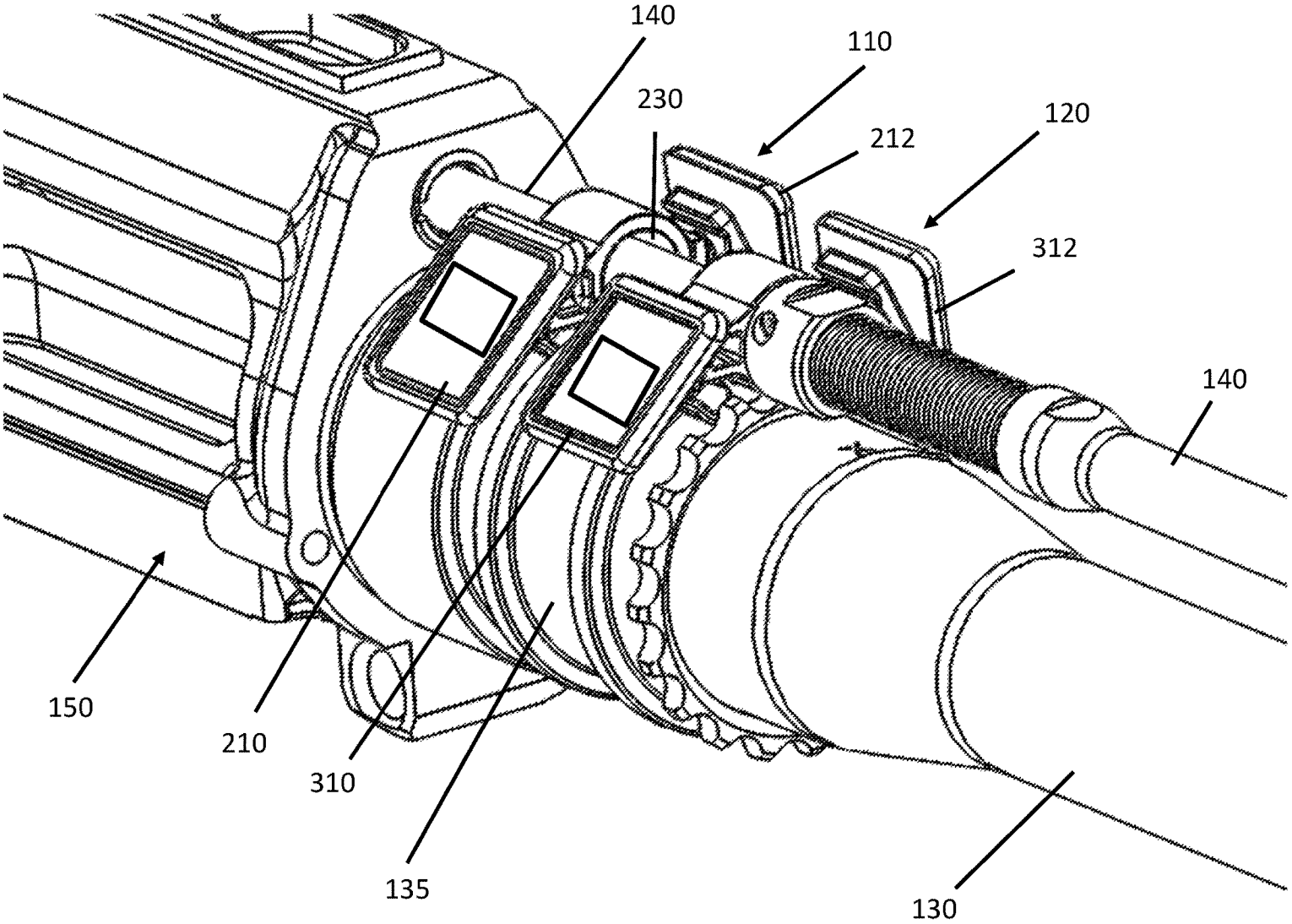
FIG. 2 illustrates a top, right-side perspective view of an example handguard clamp assembly system for a firearm, in accordance with an embodiment of the present disclosure.

FIG. 2 illustrates a top, right-side perspective view showing a portion of an upper receiver 150, barrel assembly, and clamps 110, 120 of handguard assembly 200, in accordance with an embodiment of the present disclosure. The barrel nut 135 secures the barrel 130 to the upper receiver 150, in accordance with an embodiment of the present disclosure. For example, the barrel nut 135 connects the barrel 130 to the upper receiver 150 by threading onto the distal end of the upper receiver 150 and accepting a threaded end of the barrel 130. The handguard 205 is not shown in FIG. 2 to more clearly show the underlying components of the assembly that secure the handguard 205 to the upper receiver 150 of the firearm. It will be appreciated in light of the present disclosure that the handguard 205 interfaces with the assembly shown in FIG. 2 to secure the handguard to the firearm.

The handguard 205 (shown in FIG. 1) can be secured to the firearm using first clamp 110 and second clamp 120, in accordance with some embodiments. Each of clamps 110, 120 is configured to interface with the barrel nut 135 and provide the clearance necessary for an operating rod 140 to move longitudinally within the handguard 205. As described in greater detail herein, each of the clamps 110, 120 includes a first clamp portion 210, 310 and a second clamp portion 212, 312 that are drawn together by a fastener (shown in FIG. 1). Each of the first clamp portions 210, 310 and the second clamp portions 212, 312 of the clamps 110, 120, respectively, engage opposite sides of the handguard 205 (shown in FIG. 1), as will be appreciated in light of the present disclosure. The operating rod 140 travels through cavity 230 defined through each of the first clamp portions 210, 310.

Figure 3:
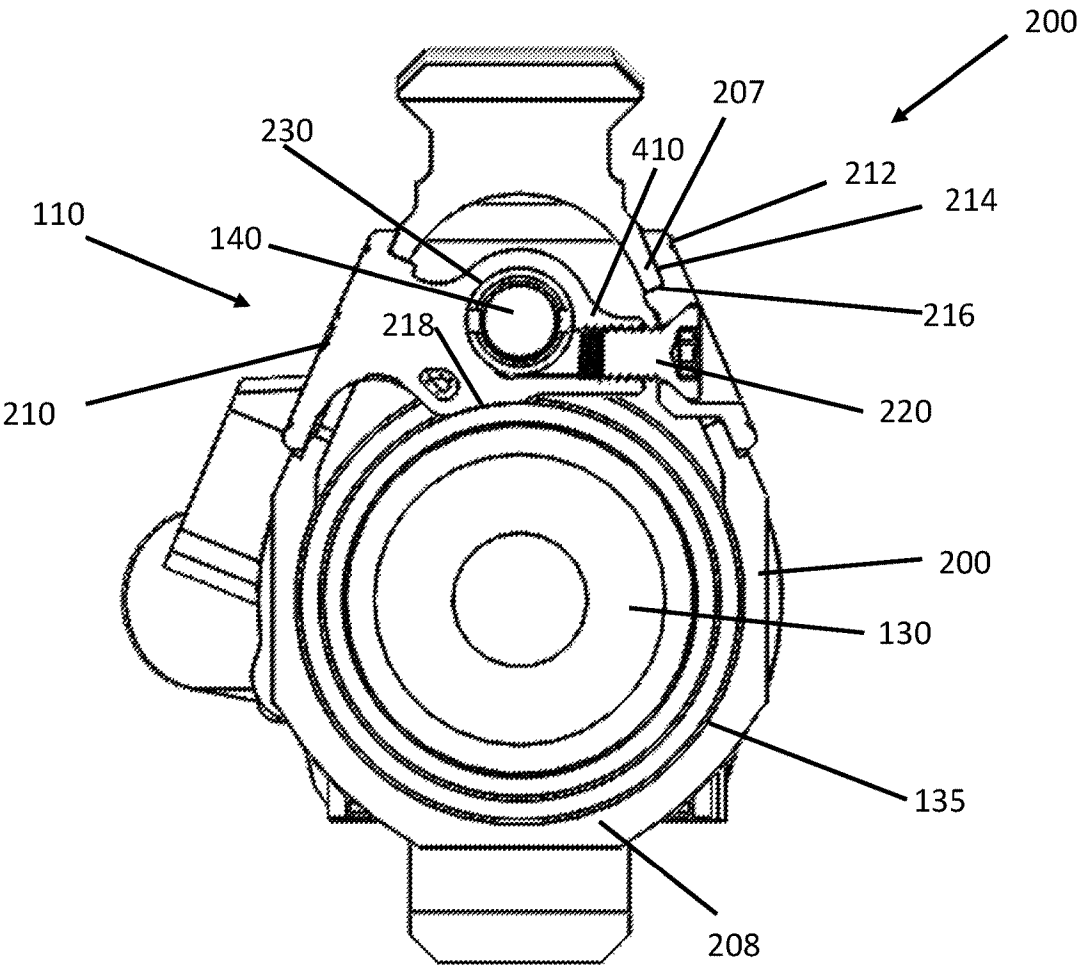
FIG. 3 illustrates a cross-sectional view of an example handguard assembly as taken through the barrel and handguard, in accordance with an embodiment of the present disclosure.

FIG. 3 illustrates a cross-sectional view of an example handguard assembly 200 as taken through the handguard 205, barrel 130, and clamp 110, in accordance with an embodiment of the present disclosure. Clamp 110 includes a first clamp portion 210 and a second clamp portion 212. The first portion 210 includes an arced surface 218 on the bottom of the clamp 110 that is engages an outside surface of the barrel nut 135. For example, the arced surface 218 is configured to engage the top of the barrel nut 135 when the handguard 205 is installed on the firearm. The first clamp portion 210 includes a cavity 230 that has sufficient clearance for the operating rod 140 (or gas piston) to pass therethrough. When installed on the firearm, the first clamp portion 210 extends laterally over the top of the barrel 130 with the operating rod 140 extending through cavity 230, such as shown in FIG. 3. The cavity 230 allows the operating system of the firearm to pass through the clamp. The operating system can be a gas tube, gas piston, or other feature used to delay or initiate the cycling of the firearm, as will be appreciated. It will be appreciated in light of the present disclosure that the first portion 210 of the clamp 110 can be used with a firearm that does not include an operating rod 140, but that includes a gas tube or other similarly positioned feature, or that lacks any feature in the position where the operating rod 140 would be.

The second clamp portion 212 includes a flange portion 214 and a boss portion 216. The flange portion 214 has an inside face 215 that is configured to contact an outside surface of the handguard 205 when installed on the firearm. The boss portion 216 is configured to be received in and bear against a surface along a corresponding boss opening (e.g., first lateral opening 322) in the handguard 205. Fastener 220 extends through the second clamp portion 212 and threaded into a threaded portion 410 of the first clamp portion 210. As the fastener 220 is tightened, the clamp 110 draws opposite sides of the handguard 205 inward towards each other and the lower portion 208 upward against the bottom of the barrel nut 135 when the handguard 205 is installed on the firearm.

A fastener 220, shown as a screw in this example, draws together the first clamp portion 210 and the second clamp portion 212 when fastened or otherwise tightened. In an example embodiment, the first clamp portion 210 can include a threaded portion 410 that is configured to mate with the fastener 220 to draw the first clamp portion 210 and the second portion 212 together when the handguard is installed on the firearm. In this embodiment, screw 220 is in tension and clamp portions 210 and 212 are in compression against the upper portion 207 of the handguard.

Figure 4:
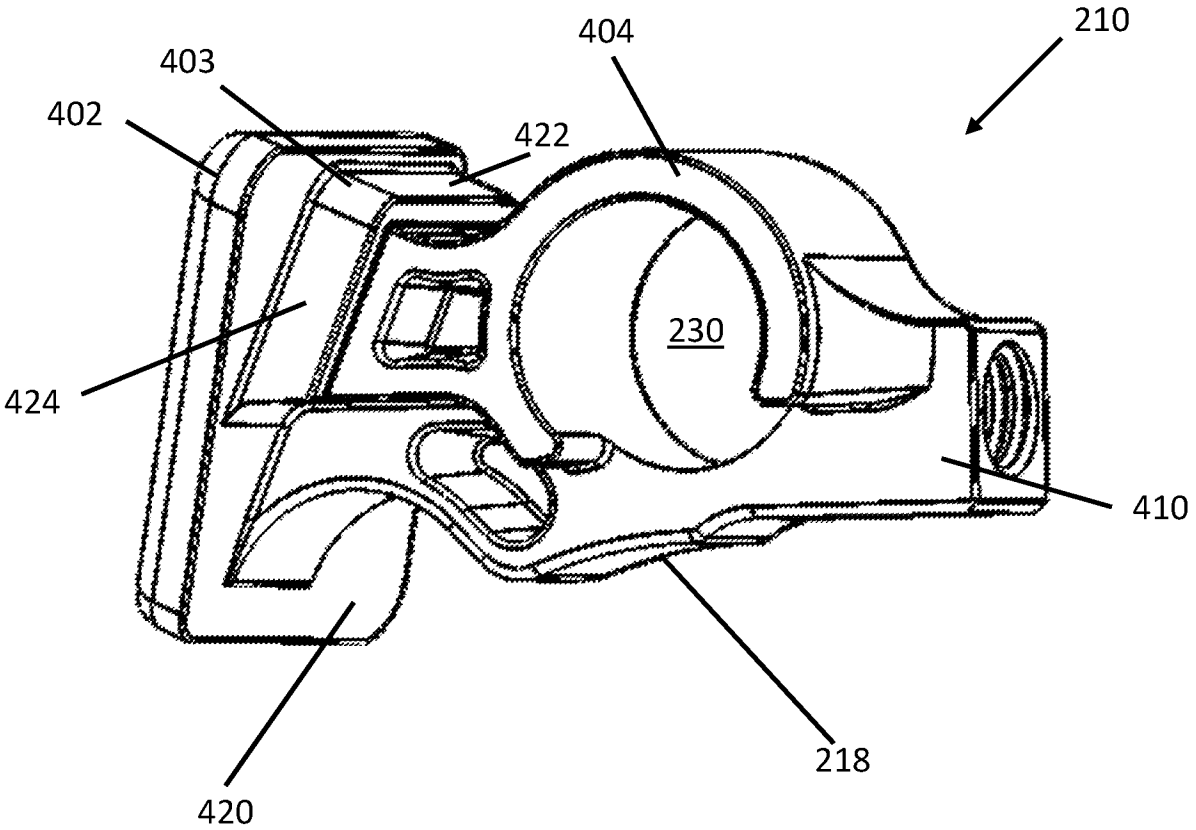
FIG. 4 illustrates a perspective view of a first portion of one clamp, in accordance with an embodiment of the present disclosure.

FIG. 4 illustrates a front, perspective view of a first clamp portion 210 of one clamp (for example, clamp 110 shown in FIG. 1), in accordance with an embodiment of the present disclosure. It will be appreciated in light of the present disclosure that the first clamp portion 310 of the second clamp 120 (shown in FIG. 1) can have the same structure. The first clamp portion 310 includes a flange portion 402, boss portion 403 of smaller size on an inside face 420 of the flange portion 402, and a clamp body 404 extending laterally from the flange and/or boss portions 402, 403. In some embodiments, the clamp body 404 defines cavity 230, such as a through-opening. The cavity 230 is sized to provide sufficient clearance for reciprocating movement of the operating rod (shown in FIG. 2) or another operating system of the firearm. Below the cavity 230, the clamp body 404 defines an arced surface 218. As shown in FIG. 4, the arced surface 218 has a concave shape along the bottom of the first clamp portion 210, the concave shape corresponding to the outside surface of the barrel nut 135. In one embodiment, the arced surface 218 curves upward as it extends toward the threaded portion 410. Accordingly, when a fastener 220 engaged in the threaded portion 410 is tightened, the arced surface 218 is drawn across the barrel nut 135, raising the clamp body 404 and drawing the lower portion 208 of the handguard 205 upward against the bottom surface of the barrel nut 135 or upper receiver connector 350.

The clamp body 404 also defines a threaded portion 410 positioned at the opposite end of the clamp body 404 from the flange portion 402. For example, the cavity 230 is located approximately in the middle of the clamp body 404 with the flange and boss portions 402, 403 at one end and the threaded portion 410 at the other end. The threaded portion 410 is configured to engage with a fastener 220 when the handguard is installed on the receiver of a firearm. The flange portion 402 can include an inside-face 420 that interfaces with an outside surface of the first side of the handguard. When a fastener 220 between the first clamp portion 210 and the second clamp portion 212 is tightened, the first and second clamp portions 210, 212 drawn together along with opposite sides of the handguard 205. In some embodiments, the boss portion 403 includes a top bearing surface 422 and a side bearing surface 424 that are configured to interface with the handguard when received in an opening in the handguard 205. The top bearing surface 422 draws the handguard 205 upward when the fastener 220 between the first and second clamp portions 210, 212 is tightened. The side bearing surface(s) 424 of boss portion 403 similarly engage the handguard 205 to reduce or prevent movement of the handguard 205 along the bore axis.

Figure 5:
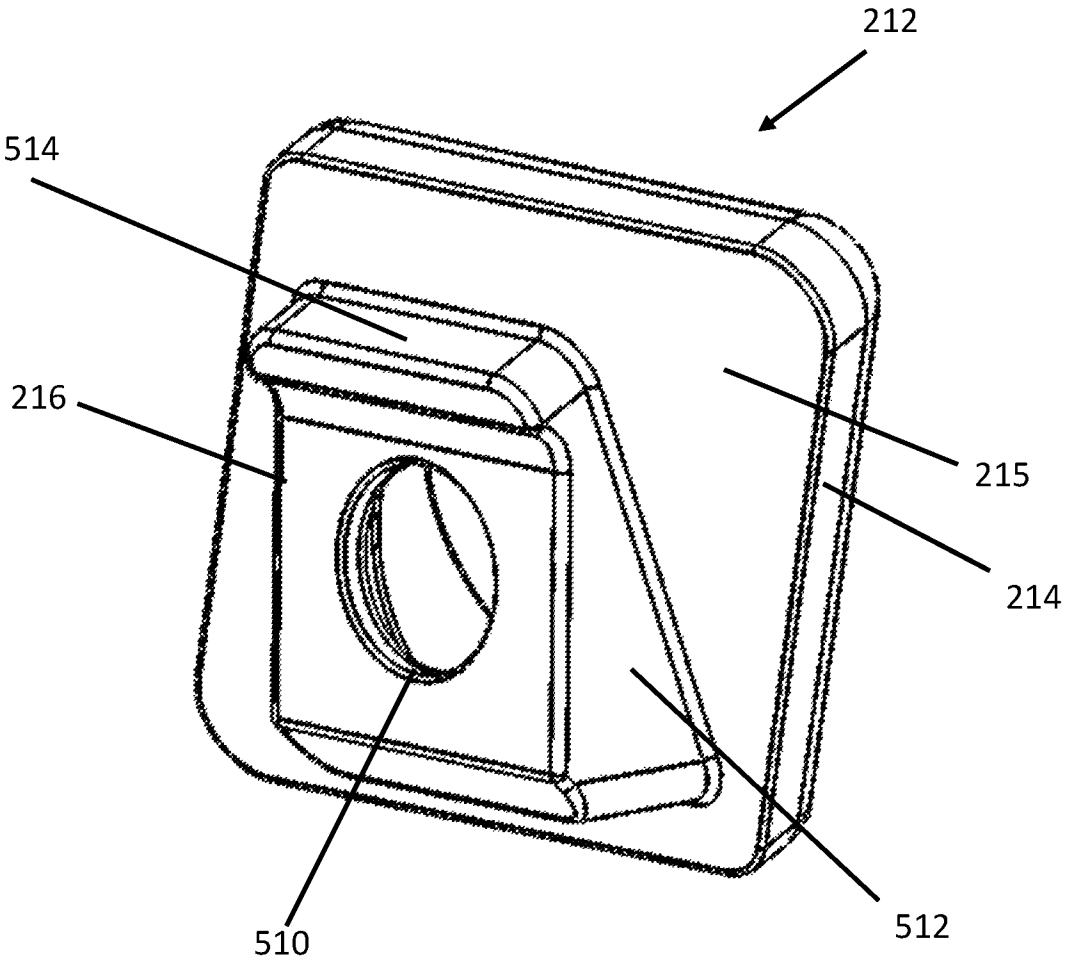
FIG. 5 illustrates a perspective view of a second portion of one clamp, in accordance with an embodiment of the present disclosure.

FIG. 5 illustrates a perspective view of a second clamp portion 212 of one clamp (for example, clamp 110 shown in FIG. 1), in accordance with an embodiment of the present disclosure. It will be appreciated in light of the present disclosure that the second clamp portion 312 of the second clamp (shown in FIG. 3) can have the same structure. The second clamp portion 212 includes a flange portion 214 and a boss portion 216. The flange portion 214 has an inside face 215 that is configured to contact an outside surface of the handguard 205 when installed on the firearm. The flange portion 214 is configured to draw the side of the handguard inward towards the barrel nut when a fastener 220 is installed and tightened between the first and second clamp portions 210, 212. The flange portion 214 is located radially outside of the boss portion 216 with respect to the barrel 130. The boss portion 216 provides a top bearing surface that is configured to bear against a corresponding opening (e.g., second lateral opening) in the handguard 205 when the handguard 205 is installed on the firearm. The boss portion 216 is configured to draw the handguard 205 upward when the fastener 220 is tightened.

The second clamp portion 212 also defines an opening 510 for receiving the fastener (for example, fastener 220). For example, the opening 510 is threaded. The boss portion 216 can include a side bearing surface 512 that, together with a top bearing surface 514, interfaces with the handguard. For example, the top bearing surface 514 draws the handguard 205 upward when the fastener 220 is tightened and the side bearing surfaces reduce or prevent axial movement of the handguard 205.

Figure 6:
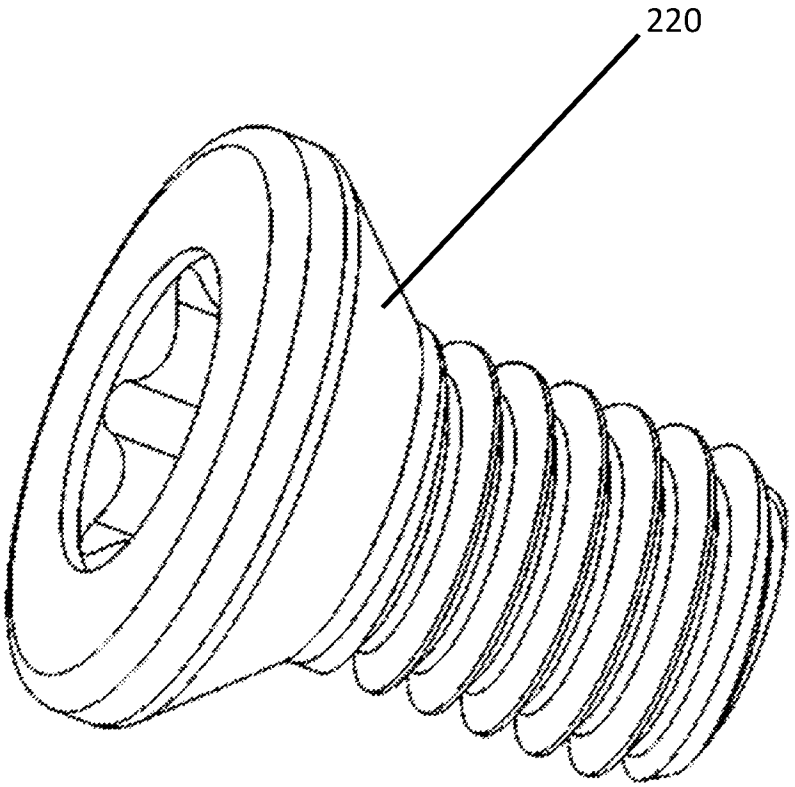
FIG. 6 illustrates a perspective view of a screw fastener for securing the first portion of the clamp and the second portion of the clamp together, in accordance with an embodiment of the present disclosure.

FIG. 6 illustrates a perspective view of a fastener 220 configured as a screw for securing the first clamp portion 210 to the second clamp portion 212, in accordance with an embodiment of the present disclosure. It will be appreciated that although fastener 220 is shown and described as a screw, other fasteners can be implemented, such as a cam clamp, rivet or other suitable fastener.

Figure 7:
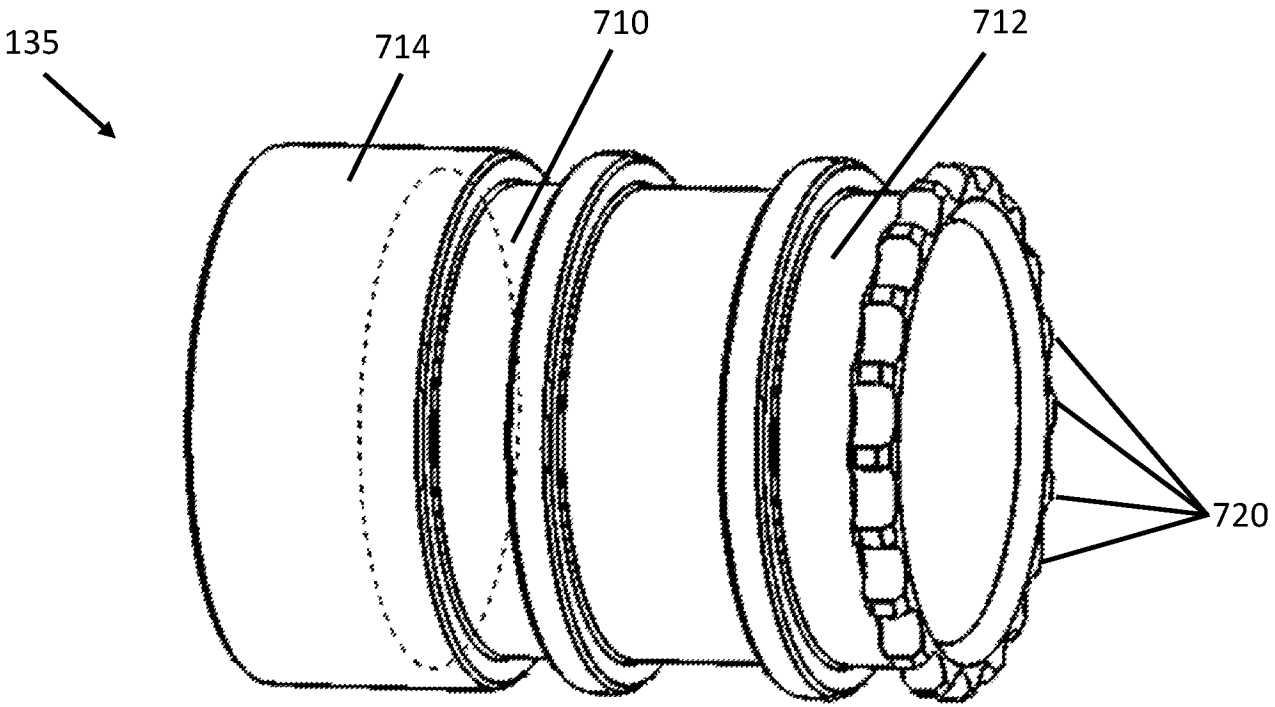
FIG. 7 illustrates a perspective view of a barrel nut having a groove for each of the clamps, in accordance with an embodiment of the present disclosure.

FIG. 7 illustrates a perspective view of a barrel nut 135 having a groove 710, 712 for each clamp 110, 120, in accordance with an embodiment of the present disclosure. The barrel nut 135 secures the barrel 130 to the upper receiver of the firearm. In this embodiment, the barrel nut 135 is also for interfacing with the clamps (for example, clamps 110, 120 in FIG. 2). The barrel nut 135 can include a first groove 710 for interfacing with the first clamp (for example, clamp 110), and a second groove 712 for interfacing with the second clamp (for example, clamp 120). As shown in FIG. 3, for example, the clamp 110 can have an arced surface 218 that is configured to contact the outside surface of the barrel nut 135 along the groove 710. In one example, a proximal end portion 714 of the barrel nut 135 has female threads that receive the upper receiver connector 350. In such embodiments, the lower portion 208 of the handguard 205 engages the outside surface of the proximal end portion 714 when the handguard 205 is installed on the firearm. The barrel nut 135 can include a distal end with raised surfaces 720 for fastening the barrel nut 135 to the upper receiver (upper receiver is not shown in FIG. 7). Refer, for example, to FIG. 1 showing the barrel nut 135 that is configured to releasably engage with the barrel nut connector 350 of the upper receiver 150 of the firearm.

Figure 8:
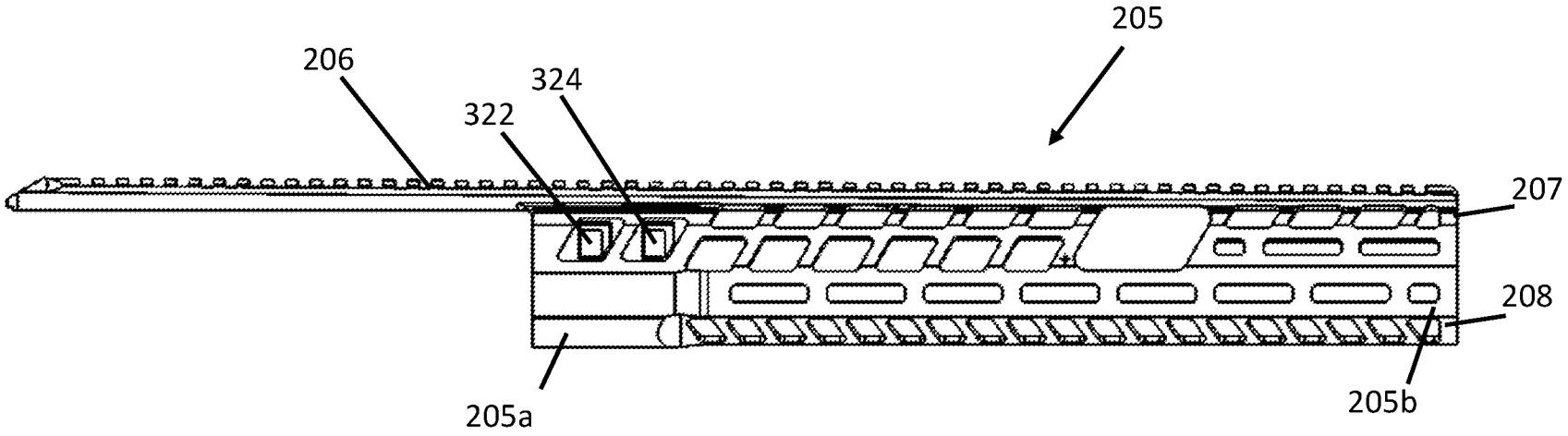
FIG. 8 illustrates a perspective side view of a handguard having two openings on each side for each receiving a portion of a clamp, in accordance with an embodiment of the present disclosure.

FIG. 8 illustrates a perspective side view of a handguard 205 having openings 322, 324 on each side for receiving a portion of a clamp, in accordance with an embodiment of the present disclosure. The handguard 205 is an elongate perforated structure extending between a proximal end portion 205*a* and a distal end portion 205*b*. The handguard 205 can include a mounting rail 206 extending along an upper portion 207 of the handguard 205. The proximal end portion 205*a* defines a first lateral opening 322 and a third lateral opening 324. As will be appreciated in light of the present disclosure, the first lateral opening 322 is axially aligned with a second lateral opening (not visible in FIG. 8), and the third lateral opening 324 is axially aligned with a fourth lateral opening (not visible in FIG. 8). The first lateral opening 322 and the third lateral opening 324 are on a first side of the handguard 205, and the second and fourth lateral openings are positioned on a second side of the handguard 205 opposite the first side. The first lateral opening 322 is for receiving a first clamp portion of the first clamp 110, and the third lateral opening 324 is for receiving a first clamp portion of the second clamp 120, in accordance with an embodiment of the present disclosure.

Figure 9:
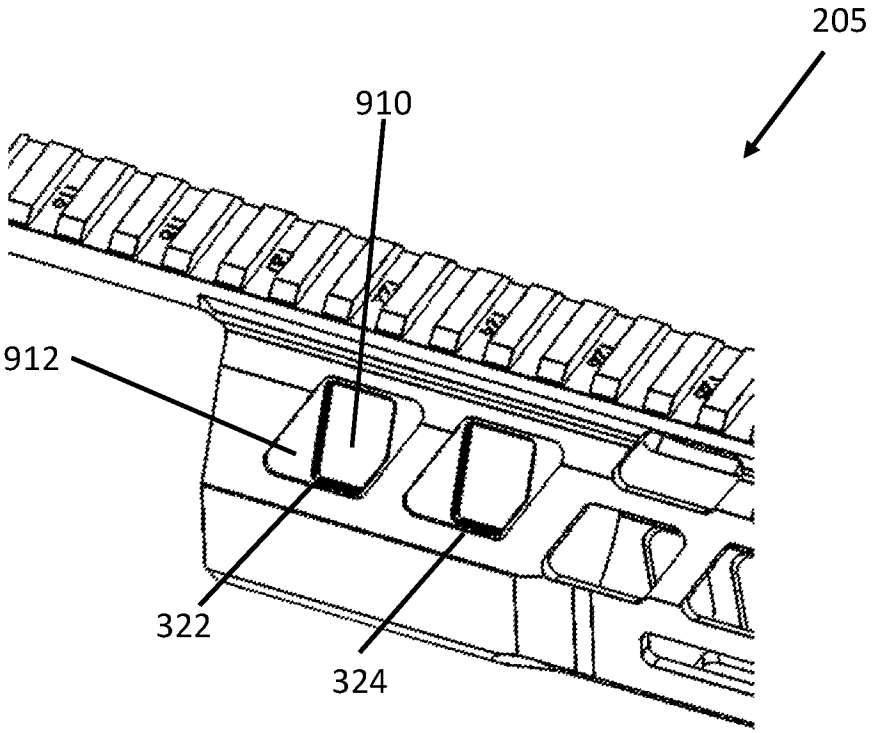
FIG. 9 illustrates a partial side view of the handguard of FIG. 8, showing the two openings on the first side, in accordance with an embodiment of the present disclosure.

FIG. 9 illustrates a side perspective view of part of the handguard of FIG. 8, showing the first and third lateral openings 322, 324 on the first side, in accordance with an embodiment of the present disclosure. Each lateral opening 322, 324 is in addition to the plurality of perforations typically on the handguard 205.

In accordance with an embodiment, the first lateral opening 322 receives the first clamp portion 210 of first clamp 110, for example. With continued reference to FIGS. 4 and 9, the first lateral opening 322 provides a through opening 910 for boss potion 403 to pass therethrough. Through opening 910 is surrounded at least in part by a recess 912 or other surface providing an effective stop for the inside face 420 of the flange portion 402. Surfaces of the handguard 205 extending around the through opening 910 interface with the top and side bearing surfaces 422, 424 to secure the clamp to the first side of the handguard 205. The inside face 420 of the flange portion 402 is securely retained against the recess 912 adjacent the through opening 910. The inside face 420 can rest against the recess 912 to secure the handguard to the rifle. In one embodiment, the through opening 910 has a rectangular shape with rounded corners, consistent with a corresponding shape of the boss portion 403. In one embodiment, the recess 912 is shaped as a rhombus or parallelogram, consistent with a corresponding shape of the flange portion 402. Numerous other shapes and configurations are acceptable, as will be appreciated.

Methodology

Figure 10:
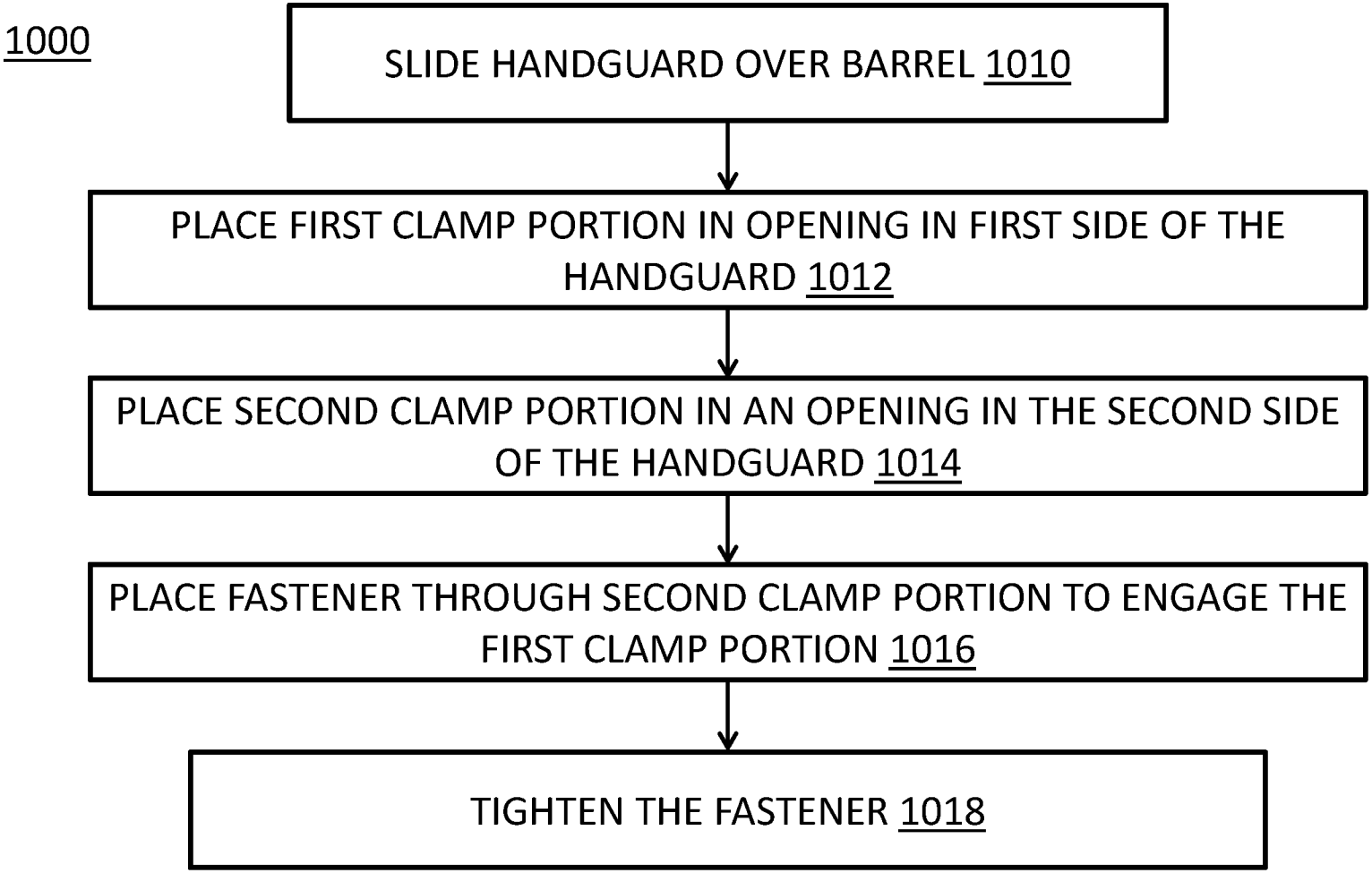
FIG. 10 illustrates a flowchart illustrating a method of attaching a handguard to a firearm in accordance with an embodiment of the present disclosure.

Referring now to FIG. 10, another aspect of the present disclosure is directed to a method 1000 of attaching a handguard to a firearm. In accordance with an embodiment, the method 1000 of attaching a handguard to a firearm includes at 1010 sliding the handguard over the barrel. Sliding 1010 the handguard includes placing the proximal end portion of the handguard over the barrel nut and/or upper receiver connector. It will be appreciated in light of the present disclosure that sliding 1010 the handguard over the barrel can include sliding the handguard over the gas block and operating rod or gas tube. At 1012, the first clamp portion of the clamp is placed through an opening in one side of the handguard. This opening can, for example, be the first opening 322 shown in FIGS. 1, 8, and 9. Placing 2012 the first clamp portion can include positioning a flange portion of the first clamp against the handguard with the clamp body extending laterally over the barrel nut. At 1014, the second clamp portion is placed in an opening in the second side of the handguard. At 1016, a fastener is placed through the second clamp portion and positioned to engage the first clamp portion. For example, the second opening is opposite the first opening and axially aligned with the second opening so that when the fastener is tightened, the first clamp portion and the second clamp portion are drawn together. The second opening can, for example, be the opposite the first lateral opening 322 shown in FIGS. 1 and 9. At 1018, the fastener is tightened to draw opposite sides of the handguard together and to draw the handguard against the barrel nut and/or upper receiver connector. It will be appreciated in light of the present disclosure that one or more portions of the method can be repeated for the second clamp so that two clamps are provided to secure the handguard to the firearm.

Handguard Assembly

Figure 11:
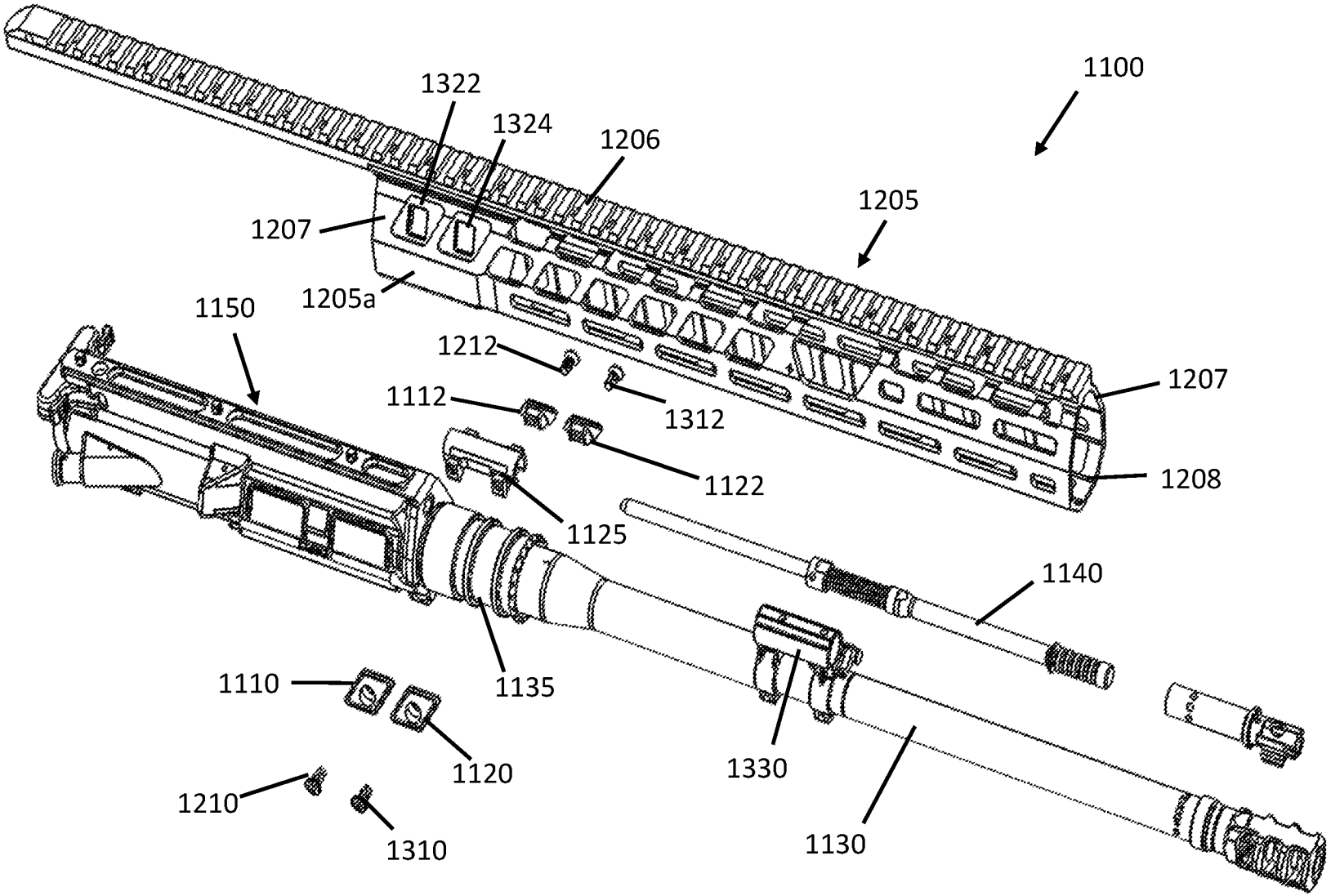
FIG. 11 illustrates an exploded view of an example handguard assembly and part of a firearm, showing the handguard, the upper receiver, the barrel assembly, the flanges, the fasteners for the flanges, the connector, and the operating rod, in accordance with an embodiment of the present disclosure.

FIG. 11 illustrates an exploded view of a handguard assembly 1100 configured to be attached to a firearm, in accordance with an embodiment of the present disclosure. In one example, the firearm includes an upper receiver 1150; a barrel assembly that includes a barrel 1130, barrel nut 1135, and gas block 1330 on the barrel 1130; and an operating rod 1140. As shown in FIG. 11, the barrel 1130 is secured to the upper receiver 1150 by threading the barrel nut 1135 into the upper receiver connector 350 (shown in FIG. 1).

When assembled, the operating rod 1140 extends between the gas block 1330 and the upper receiver 1130. The barrel assembly shown in FIG. 11 has an operating rod 1140 configured as a gas piston. Upon discharging the firearm, the gas block 1330 directs pressurized gas from the barrel 1130 to actuate the operating rod 1140 to cycle the action. Depending upon the firearm, gas can either directly operate the action of the firearm (e.g., direct impingement), or can drive the operating rod 1140 or another component of the firearm.

In one embodiment, the handguard assembly 1100 includes a handguard 1205 defining openings on opposite sides of the handguard, where each opening is configured to receive a flange insert; a connector disposed between the handguard 1205 and the barrel nut 1135; flange inserts that are received in the openings in the handguard 1205; and fasteners to secure the flange inserts to the connector. In one example embodiment, the proximal end portion 1205*a* of the handguard 1205 defines a first lateral opening 1322 on a first side of the handguard, which receives the first flange insert 1110, and a second lateral opening (not visible in FIG. 11) opposite the first opening 1322 and which receives the second flange insert 1112. The handguard 1205 may include two (or more) additional lateral openings on opposite sides of the handguard for receiving the flange inserts 1120 and 1122. The flange inserts 1112, 1122 are secured to the connector 1125 by fasteners 1212 and 1312, respectively. The flange inserts 1110 and 1120 are secured to the connector 1125 by fasteners 1210 and 1310, respectively. Although embodiments of the handguard 205, 1205 are described herein as having one or more pairs of aligned openings on opposite sides of the handguard 205, 1205, some embodiments can have more or fewer openings on each side of the handguard. For example, each lateral opening may or may not correspond to an opposite lateral opening and each lateral opening may or may not be aligned with a lateral opening on the opposite side of the handguard. Numerous embodiments and variations are acceptable, as will be appreciated.

The first lateral opening 1322 may be aligned with an opposing second lateral opening (not visible in FIG. 11) on the opposite side of the handguard 1205. Likewise, the third lateral opening 1324 may be aligned with a fourth lateral opening on the opposite side of the handguard 1205 (not visible in FIG. 11). In this manner, fasteners 1210 and 1212 can be aligned along a common axis, and fasteners 1310 and 1312 can similarly be aligned along a common axis.

Figure 22:
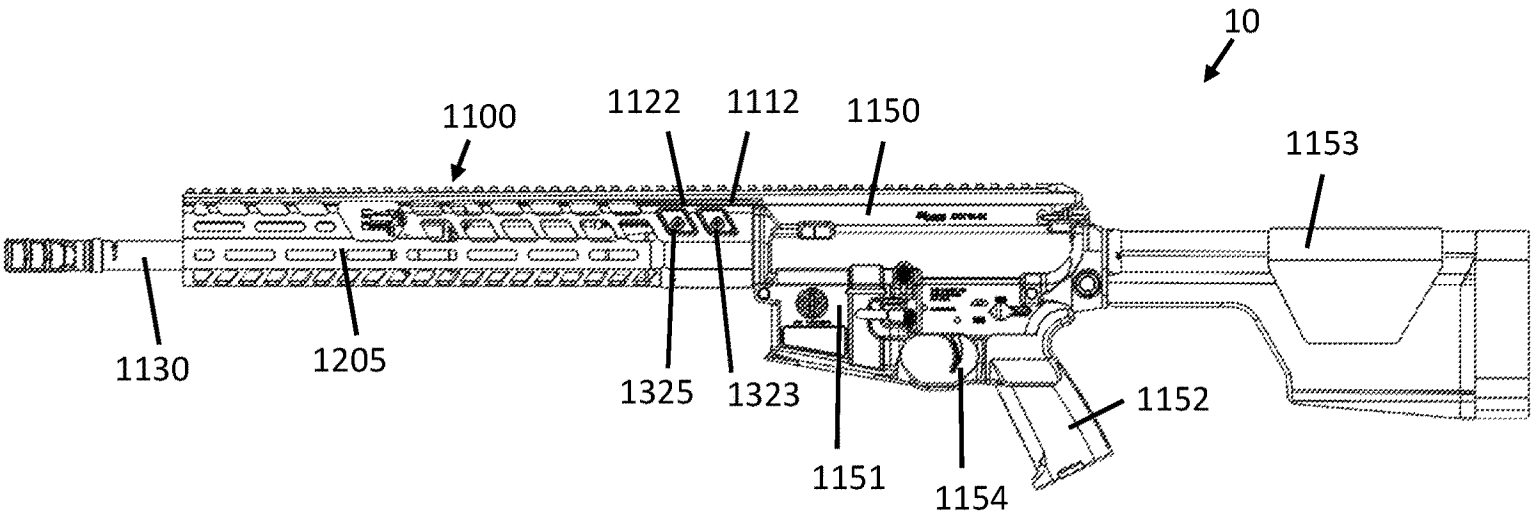
FIG. 22 illustrates a left-side view of an example firearm with a handguard attachment assembly installed thereon, in accordance with an embodiment of the present disclosure.

The connector 1125 can be disposed on top of the barrel nut 1135 within the proximal end portion 1205*a* of the handguard 1205. In one embodiment, the operating rod 1140 passes through a cavity 1230 extending through the connector 1125 as shown, for example, in FIG. 18. For example, the connector 1125 is placed on the barrel nut 1135 prior to the handguard being placed over the barrel 1130. The flange inserts 1110, 1112, 1120, and 1122 can then be placed into the appropriate lateral openings in the handguard 1205. The flange inserts 1110, 1112, 1120, 1122 may contact the handguard 1205 adjacent the lateral openings. The fasteners (e.g., machine screws) 1210, 1212, 1310, and 1312 are then placed to extend through the flange inserts to engage the connector 1125, and then are tightened to the connector 1125. Refer to FIG. 22 for an example sequence for assembling the handguard assembly 1100 as depicted in FIG. 11.

The handguard 1205 can be a unitary, one-piece handguard. In one embodiment, the handguard 1205 has a generally tubular shape configured to extend over the barrel assembly and operating rod 1140 without interfering with the gas block 1330 or the barrel 1130. The proximal end portion 1205*a* of the handguard 1205 is shaped and constructed to interface with the barrel nut 1135 and/or the upper receiver connector 350 (shown in FIG. 1). For example, when the barrel nut 1135 has female threads to engage male threads on the upper receiver connector 350, the lower portion 1208 of the proximal end portion 1205*a* engages the barrel nut 1135 when installed on the firearm. In other embodiments, for example, the barrel nut 1135 is received in the upper receiver connector 350 and the handguard 1205 engages the outer surface of the upper receiver connector 350 when installed on the firearm. In some embodiments, the handguard 1205 engages both the barrel nut 1135 and the upper receiver connector 350. The handguard 1205 can include a mounting rail 1206 extending along a top of the handguard 1205. For example, the rail 1206 is a Picatinny rail (MIL-STD-1913 rail) or another mounting rail. The rail 1206 may extend proximally beyond the proximal end portion 1205 of the handguard 1205 and along the top of the upper receiver 1150 when installed on the firearm.

Figure 12:
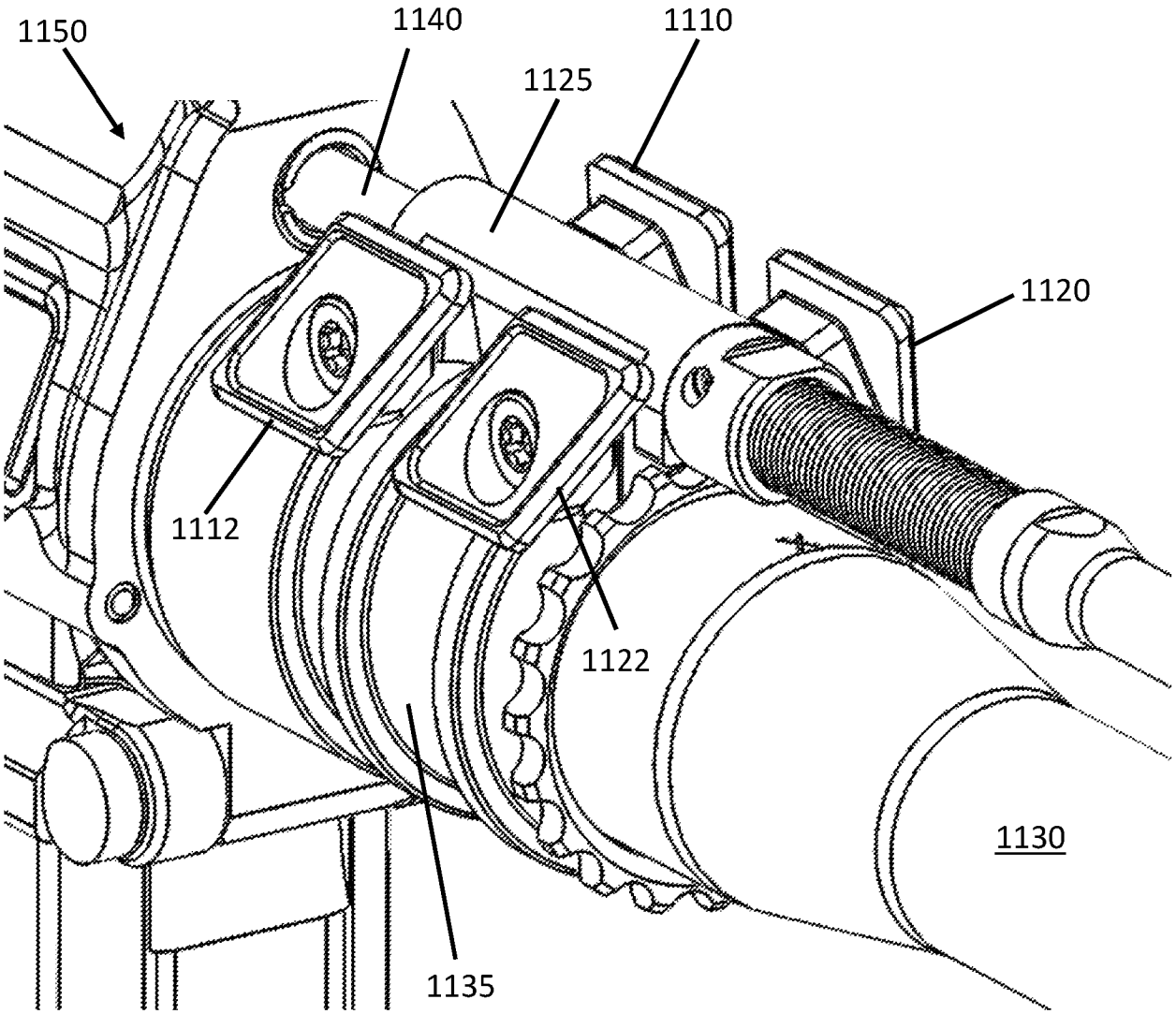
FIG. 12 illustrates a top, right-side perspective view of an example handguard assembly system for a firearm, in accordance with an embodiment of the present disclosure.

FIG. 12 illustrates a top, front, and right-side perspective view of part of a handguard assembly system for a firearm, in accordance with an embodiment of the present disclosure. The handguard is not shown in FIG. 12 to better show the underlying components of the assembly that secures the handguard to the upper receiver 1150 of the firearm. It will be appreciated in light of the present disclosure that the handguard interfaces with the assembly shown in FIG. 11 to secure the handguard to the firearm.

In one embodiment, the handguard assembly 1100 includes, together with the handguard (shown in FIG. 11), flange inserts 1110, 1112, 1120, and 1122, and connector 1125. The connector 1125 provides clearance necessary for an operating rod 1140 to move within the handguard (not shown). Each of the flange inserts 1110, 1112, 1120, and 1122 can be drawn towards the connector 1125 by an appropriate fastener that engages the connector 1125. The flange inserts 1110 and 1120 engage a first side of the handguard 1205, and the flange inserts 1112 and 1122 engage a second, opposite side of the handguard 1205. It will be appreciated that, although an operating rod 1140 is shown and described, the handguard assembly can be implemented on firearms having a different mechanism, such as a gas tube, or firearms with nothing in the position of the operating rod, for example in manually operated designs.

The barrel nut 1135 interfaces with the upper receiver 1150 of the firearm to secure the barrel 1130 to the upper receiver 1150. Thus, the barrel nut 1135 connects the barrel 1130 to the upper receiver 1150. The barrel nut 1135 also interfaces with the connector 1125 to secure the handguard (not shown) to the firearm while providing necessary clearance for the operating rod 1140.

Figure 13:
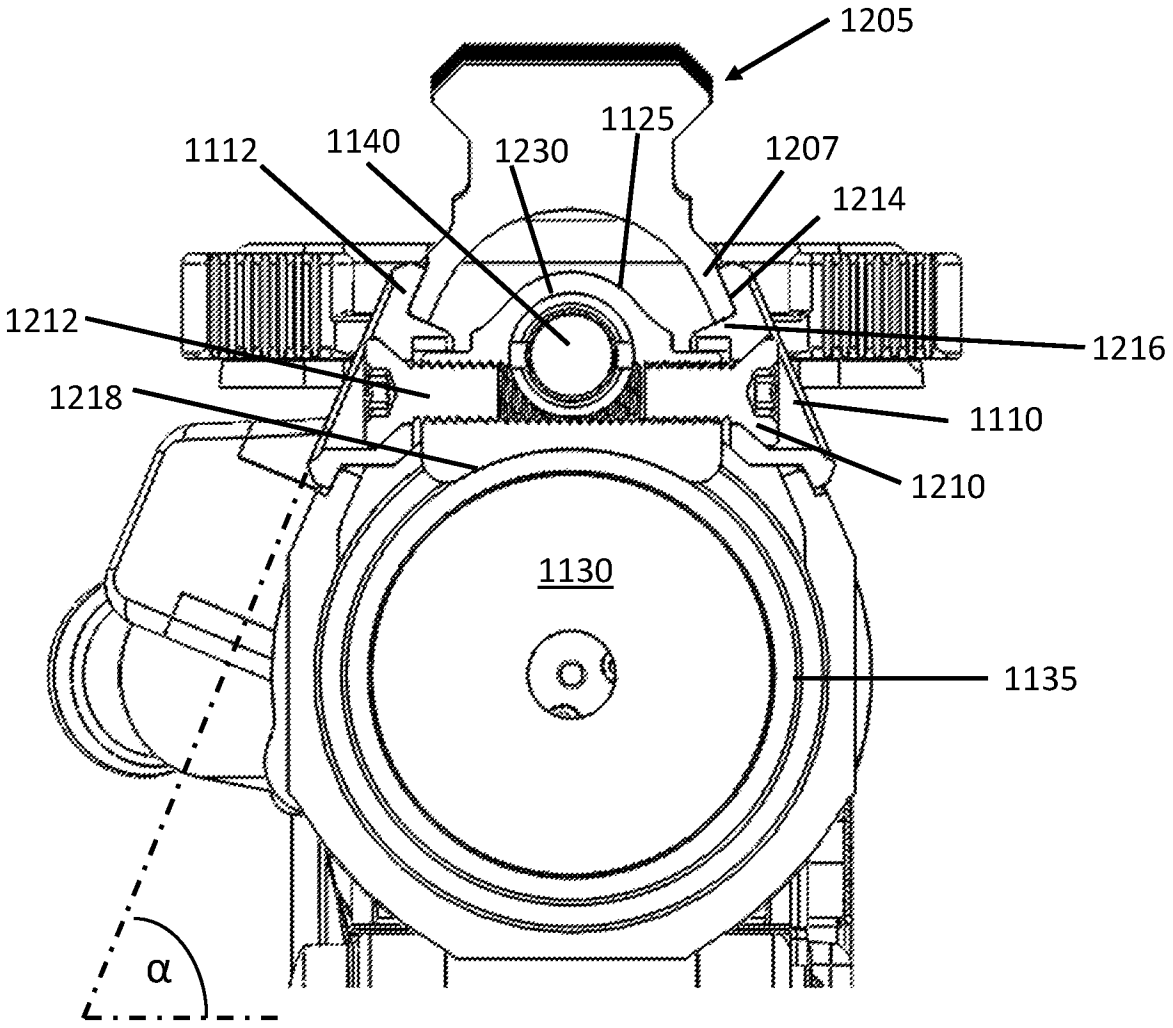
FIG. 13 illustrates a cross-sectional view of an example handguard assembly as taken through the barrel and handguard, in accordance with an embodiment of the present disclosure.
Figure 14:
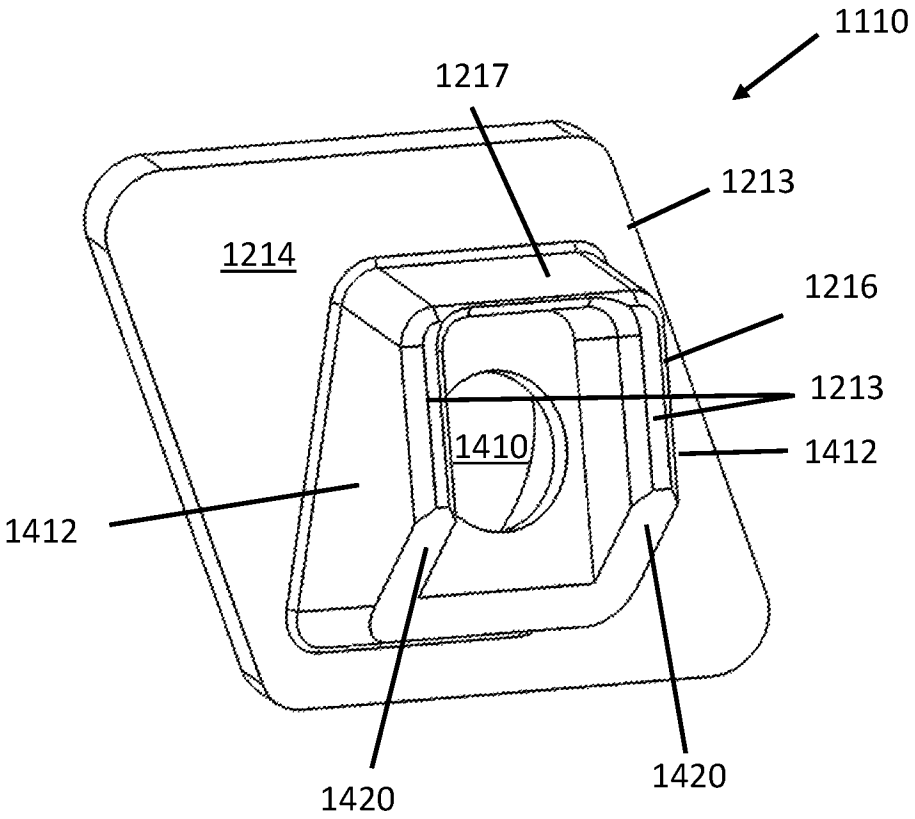
FIG. 14 illustrates a perspective view of a first side of a flange, in accordance with an embodiment of the present disclosure.
Figure 15:
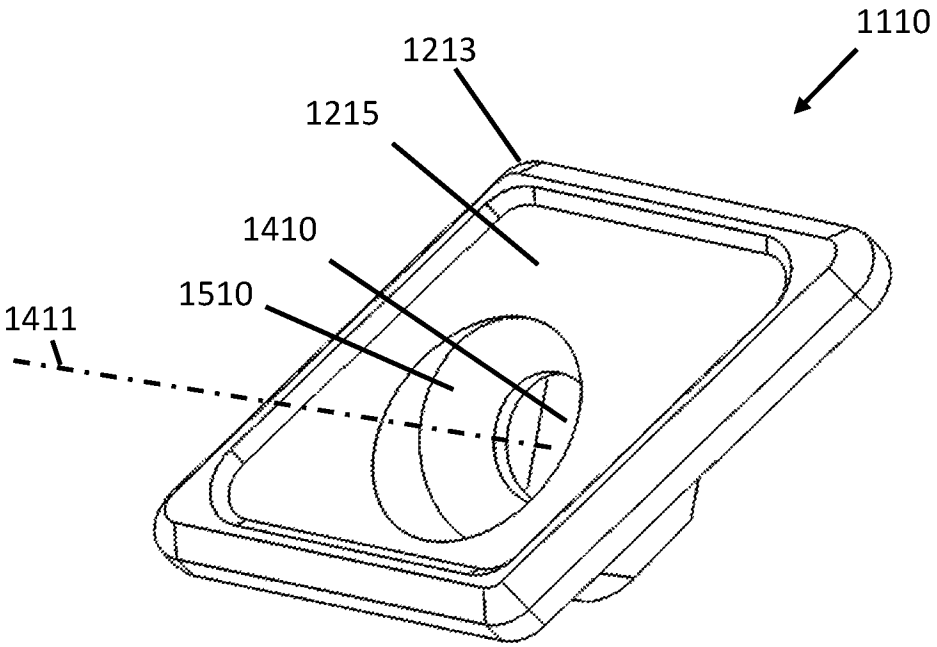
FIG. 15 illustrates a perspective view of a second side of the flange, in accordance with an embodiment of the present disclosure.

FIG. 13 illustrates a cross-sectional view of an example handguard assembly as taken through the barrel 1130, connector 1125, flange inserts 1110 and 1112, and handguard 1205, in accordance with an embodiment of the present disclosure. As shown, the flange insert 1110 is secured to the connector 1125 by a fastener 1210 and flange insert 1112 is secured to the connector 1125 by fastener 1212. Fasteners 1210, 1212 can be machine screws, for example. The flange insert 1110 has an inside face 1214 shaped to interface with the upper portion 1207 of the handguard 1205. The flange insert 1110 also has a boss portion 1216 protruding from the inside face 1214, where the boss portion 1216 is configured to be received in a corresponding lateral opening in the handguard 1205 when the handguard 1205 is installed on the firearm. Refer, for example, to FIGS. 14 and 15 showing, respectively, first and second side views of the flange insert 1110, in accordance with an embodiment of the present disclosure. The inside face 1214 is configured to draw the handguard 1205 inward toward the connector 1125 when the handguard 1205 is installed on the firearm. The boss portion 1216 is configured to bear against the handguard 1205 at the lateral opening to draw the handguard 1205 upward when the handguard 1205 is installed on the firearm.

The connector 1125 defines a cavity 1230 that has sufficient clearance for accommodating the operating rod 1140 (or gas tube). The cavity 1230 allows the operating rod 1140 to pass through the connector 1125. The firearm can include an operating rod 1140, a gas tube, gas piston, or other feature used to delay or initiate the cycling of the firearm, as will be appreciated. The connector 1125 is also applicable to a system that does not include the operating rod 1140 or other similarly positioned feature.

As shown, the connector 1125 defines an arced surface 1218 on the bottom of the connector 1125 that is configured to interface with the barrel nut 1135 The arced surface 1218 is configured to engage the top of the barrel nut 1135 when the handguard 1205 is installed on the firearm.

The fastener 1210 draws the flange insert 1112 inward toward the connector 1125 and fastener 1212 draws the flange insert 1110 inward toward the connector 1125. The fasteners 1210 and 1212 are axially aligned with respect to each other, but this is not required in all embodiments. It will be appreciated that although depicted as threaded screws, the fasteners can be any appropriate fastener, such as a cam clamp, rivet or other metal fastener.

FIG. 14 illustrates a perspective view of a first side of flange insert 1110, in accordance with an embodiment of the present disclosure. While flange insert 1110 is shown in FIG. 14 and discussed, it will be appreciated that each of flange inserts 1112, 1120, and 1122 can have the same or a substantially similar structure. The first side of the flange insert 1110 is shown in FIG. 14, which is the side of the flange that faces the connector 1125 and handguard 1205. The flange insert 1110 has a flange portion 1213 with an inside face 1214 that interfaces with the handguard. A boss portion 1216 protrudes from the inside face 1214 of the flange portion 1213. The boss portion 1216 is shaped and configured to be received in the lateral opening 1322. In some embodiments, the boss portion 1216 has a generally rectangular profile with a top bearing surface 1217 that bears against a corresponding surface along the lateral opening 1322 in the handguard 1205 when the handguard is installed on the firearm. The boss portion 1216 includes side bearing surfaces 1412 that are inserted into the lateral opening 1322 in the handguard. The side bearing surfaces 1412 and the top bearing surface 1217 interface with the lateral opening 1322 in the handguard 1205.

Figure 16:
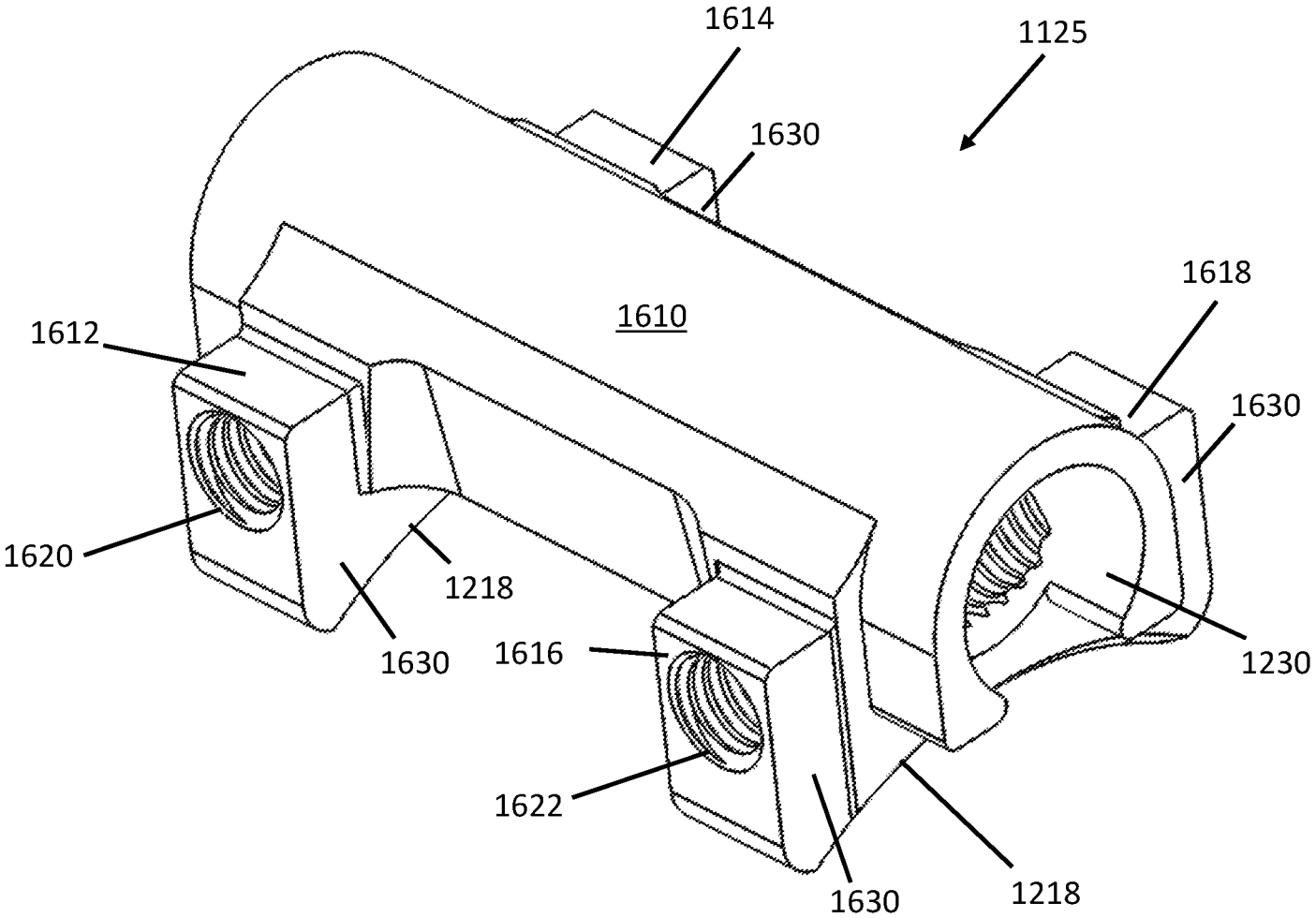
FIG. 16 illustrates a perspective top view of a connector of the example handguard assembly, in accordance with an embodiment of the present disclosure.

Sidewalls 1213 of the boss portion 1216 defining the side bearing surfaces 1412 are spaced to receive therebetween a corresponding lug of the connector 1125 (e.g., lug 1630 shown in FIG. 16). In some embodiments, lugs on the connector 1125 engage the inside of the sidewalls 1213 when the handguard 1205 is installed. Such engagement can reduce or prevent twisting of the handguard 1205 and can stabilize the handguard 1205 against recoil forces. The ends of the sidewalls 1213 may engage the outside of the connector 1125 in some embodiments. Boss control surfaces 1420 mate with the barrel nut 1135 when the assembly 1100 is installed on the firearm. As the fastener 1210 is tightened to draw the flange insert 1110 across the top of the barrel nut 1135, the boss portion 1216 is configured to draw the handguard upward with the bottom portion of the handguard 1205 engaging the bottom surface of the barrel nut 1135 and/or upper receiver connector. The flange insert 1110 includes a fastener opening 1410 for receiving the fastener therethrough (for example, fastener 1210).

FIG. 15 illustrates a perspective view showing a second side of the flange insert 1110, in accordance with an embodiment of the present disclosure. The second side of the flange insert 1110 is the side of the flange that faces away from the handguard 1205. In some embodiments, the outside face 1215 of the flange portion 1213 defines a fastener recess 1510 for receiving the head of a fastener 1210, for example the head of a screw that is inserted through fastener opening 1410. As shown in FIG. 15, the flange portion 1213 is inclined with respect to an axis 1411 of the fastener opening 1410. As shown in the cross-sectional view of FIG. 13, for example, when fastener 1210 extends horizontally, flange portion 1213 extends at an angle = of approximately 45-80 degrees to the horizontal, including 50-70 degrees, 60-70 degrees, and 45-60 degrees. In some embodiments, the angle of the flange portion is the same as or substantially the same as the angle of the corresponding upper portion 1207 of the handguard 1205. When fastener 1210 is tightened, the angle $\alpha$ results in an upward force with top bearing surface 1217 drawing handguard 1205 upward, thereby tightening the handguard 1205 against the barrel nut 1135 and securing the handguard 1205 to the firearm 10.

FIG. 16 illustrates a perspective top view of a connector 1125, in accordance with an embodiment of the present disclosure. The connector 1125 includes a cylindrical body portion 1610, a first lug 1612, a second lug 1614, a third lug 1616, and a fourth lug 1618. Cavity 1230 extends axially through the body portion 1610 of the connector 1125. The connector 1125 includes an arced surface 1218 along a bottom of the body portion 1610 and lugs 1612, 1614, 1616, 1618. In some embodiments, the connector 1125 includes two arced surfaces 1218, one along the bottom of lugs 1216 and 1618 and the other along the bottom of lugs 1612 and 1614. Each arced surface 1218 interfaces with the barrel nut 1135 when the handguard 1205 is installed on the firearm. The first lug 1612 has a first opening 1620, the second lug 1614 has a second opening (not shown), the third lug 1616 has a third opening 1622, and the fourth lug 1618 has a fourth opening (not shown).

The opening 1620 is configured for receiving a fastener that secures the appropriate flange insert to the connector 1125. For example, the first opening 1620 in first lug 1612 is threaded for fastener 1210 (e.g., threaded screw) to secure flange insert 1110. As shown, each of openings 1620, 1622 can be threaded to receive a threaded fastener when the handguard 1205 is installed on the firearm. Each lug has side surfaces 1630 that that are received in and interface with the boss portion 1216 of the flange insert. For example, control surface 1630 can interface with the boss portion 1216 of the flange insert 1110 shown in FIG. 14. Lugs 1614, 1616 and 1618 are similarly configured.

Figure 17:
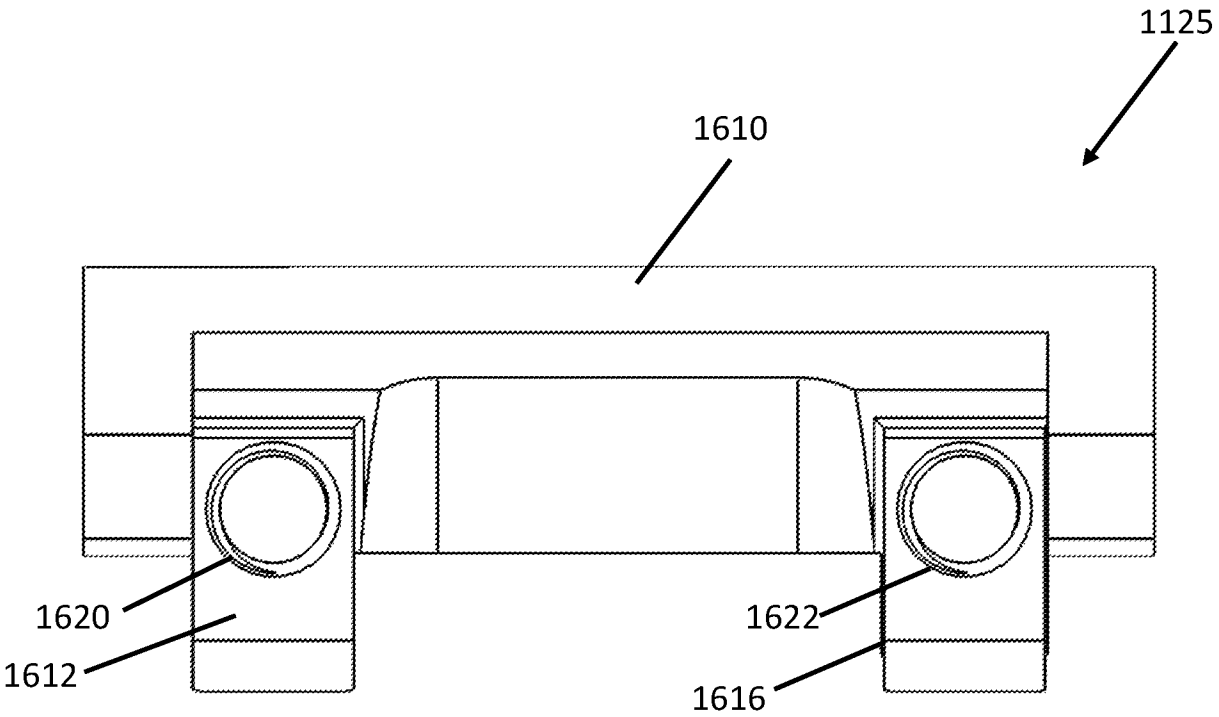
FIG. 17 illustrates a side view of the connector, in accordance with an embodiment of the present disclosure.

FIG. 17 illustrates a side view of the connector 1125, showing the fastener opening 1620 on the lug 1612, and the fastener opening 1622 on the lug 1616, in accordance with an embodiment of the present disclosure. It will be appreciated in light of the present disclosure that fastener openings on opposite sides of the connector 1125 may be aligned along a common axis, although this is not required. For example, the fastener openings in lugs 1612 and 1614 can be aligned along a common axis and fastener openings in lugs 1616 and 1618 can be aligned along a common axis. In other embodiments, for example, each fastener opening is inclined with respect to the horizontal. Numerous variations and embodiments are acceptable, as will be appreciated.

Figure 18:
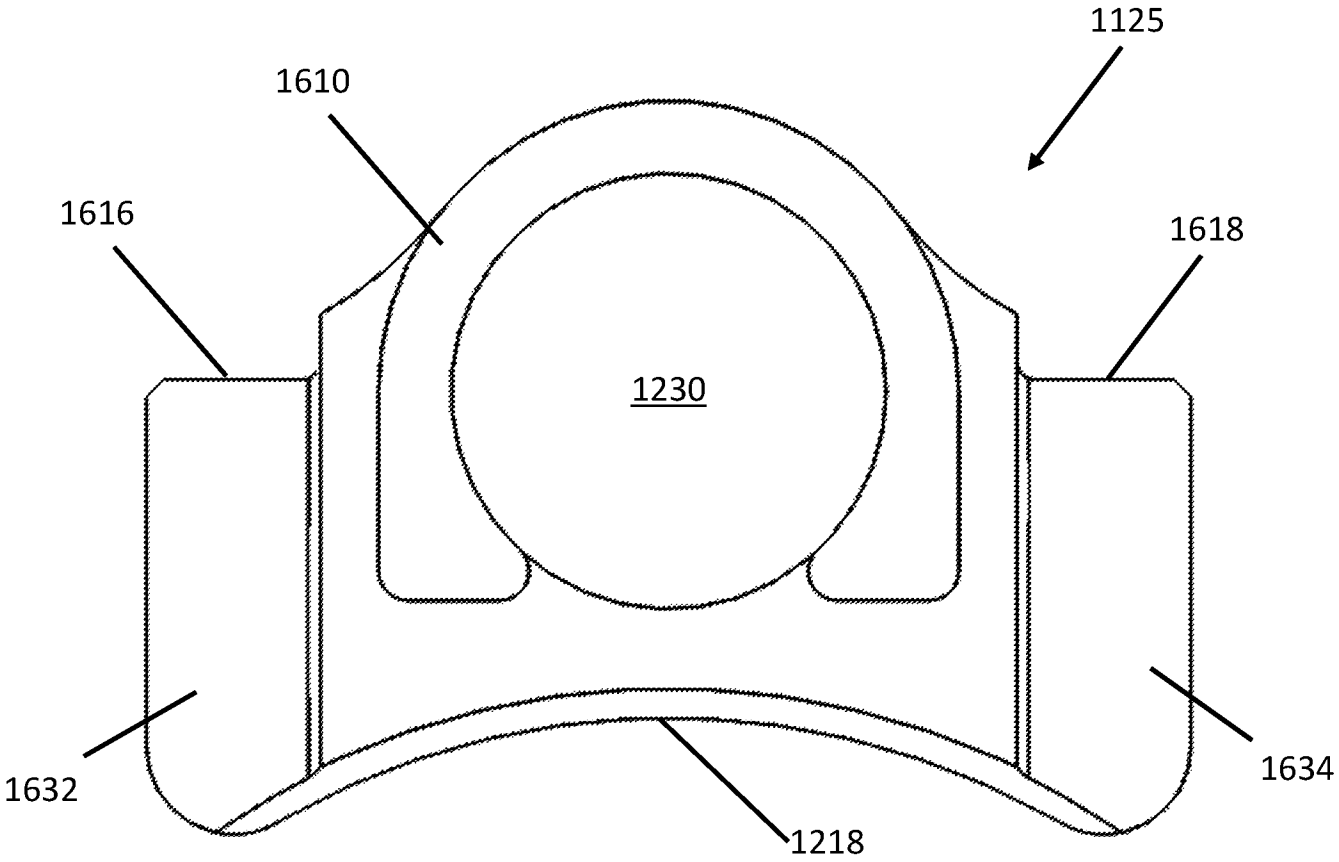
FIG. 18 illustrates a front view of the connector, in accordance with an embodiment of the present disclosure.

FIG. 18 illustrates a front view of the connector 1125, in accordance with an embodiment of the present disclosure. The bottom of the connector 1125 defines an arced surface 1218 that interfaces with a barrel nut 1135 of the firearm when the handguard is installed on the firearm. In some embodiments, each arced surface 1218 protrudes down from the body portion 1610 and is received in one of grooves 710, 712 defined in the outside of the barrel nut 1135. The cavity 1230 through the body portion 1610 provides clearance for the operating rod 1140, when present. It will be appreciated in light of the present disclosure that the handguard assembly is likewise applicable to a firearm that does not have an operating rod, and can be readily implemented on various types of firearms, both those having an operating rod, gas tube, or other similar mechanism, and those that do not. The lug 1616 and lug 1618 on the opposite side of connector 1125 are shown in FIG. 18 along with their respective surfaces 1632 and 1634.

Figure 19:
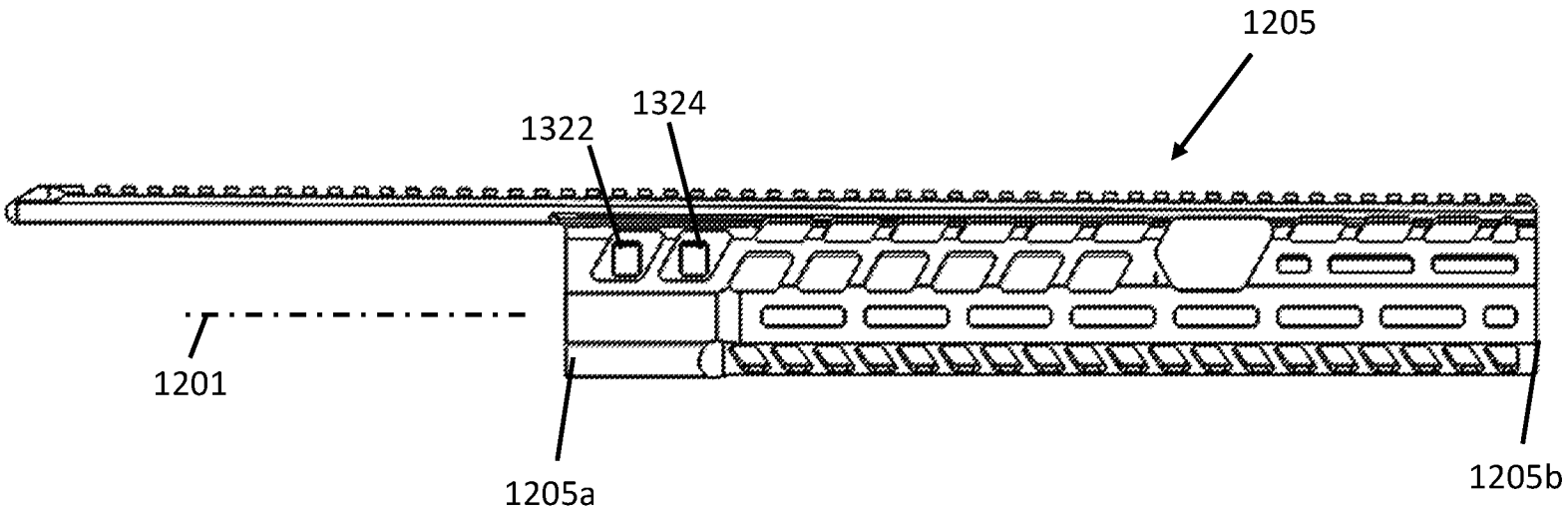
FIG. 19 illustrates a perspective side view of a handguard having two openings on each side for each receiving a portion of a clamp, in accordance with an embodiment of the present disclosure.

FIG. 19 illustrates a side view of a handguard 1205 having two lateral openings on each side for each securing a flange insert, in accordance with an embodiment of the present disclosure. The handguard 1205 is an elongate perforated structure extending along a bore axis 1201 between a proximal end portion **1205*a* and a distal end portion 1205*b*. The proximal end portion 1205*a* defines lateral openings, including a first lateral opening 1322 and a third lateral opening 1324 on one side of the handguard 1205. As will be appreciated in light of the present disclosure, the first lateral opening 1322 is axially aligned with a second lateral opening (not visible in FIG. 19), and the third lateral opening 1324 is axially aligned with a fourth lateral opening (not visible in FIG. 19) on the opposite side of the handguard 1205. The first lateral opening 1322 and the third lateral opening 1324 are positioned on a first side of the handguard 1205, and the second lateral opening and fourth lateral opening are positioned on a second side of the handguard 1205 opposite the first side. Each lateral opening is configured for receiving a flange insert (e.g., flange 1110**), in accordance with an embodiment of the present disclosure.

Figure 20:
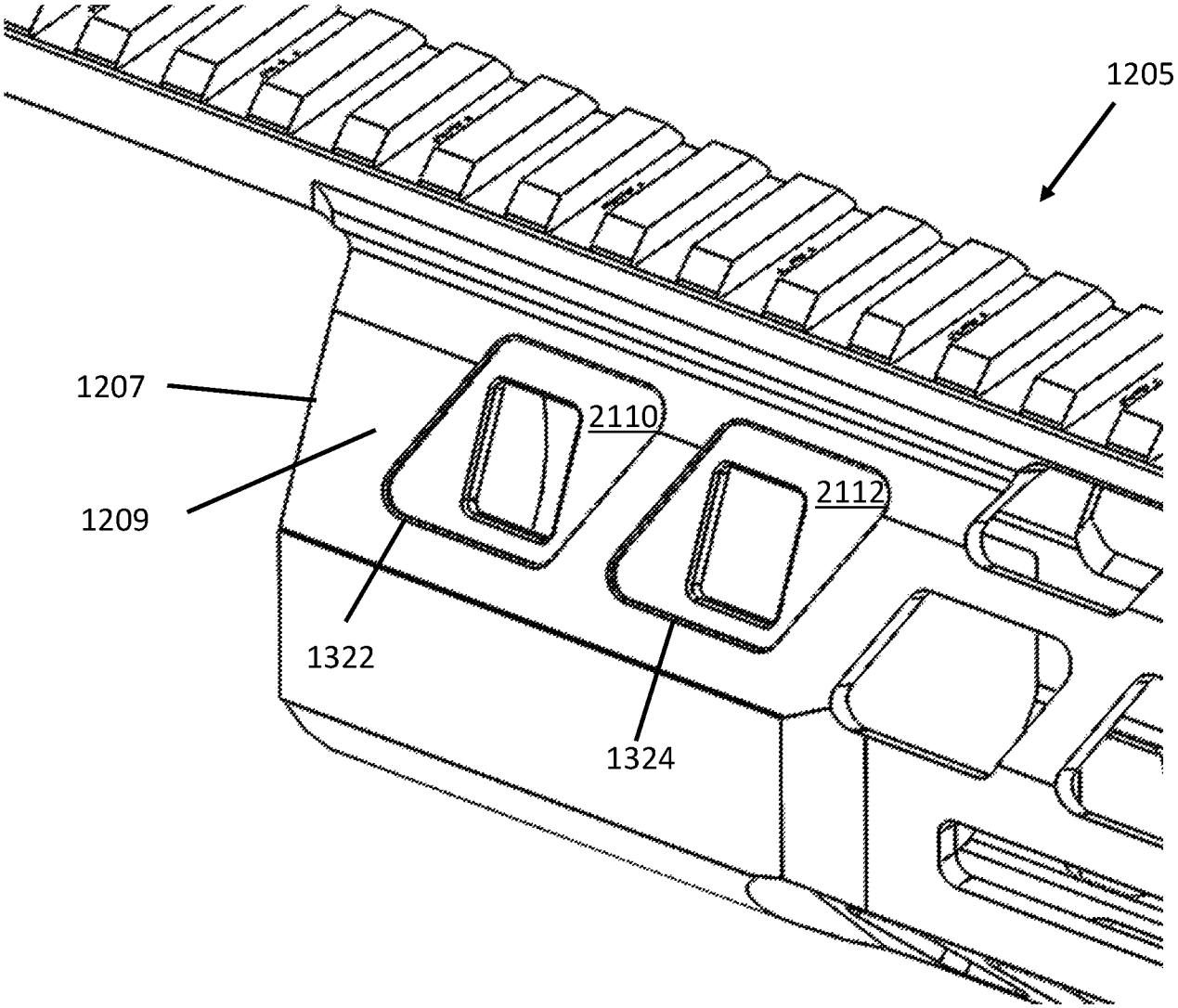
FIG. 20 illustrates a partial side view of the handguard of FIG. 20, showing the two openings on the first side, in accordance with an embodiment of the present disclosure.

FIG. 20 illustrates a perspective view of part of the handguard of FIG. 19, showing the first and third lateral openings 1322, 1324 on the first side, in accordance with an embodiment of the present disclosure. Each lateral opening is in addition to the plurality of perforations typically on the handguard 1205. The first lateral opening 1322 includes a recessed portion 2110 that interfaces with the inside face 1214 of the flange insert (e.g., flange insert 1110) to prevent lateral movement of the flange. The second lateral opening 1324 is similarly configured with recessed portion 2112. Recessed portions 2110, 2112 are configured so that flange portion 1215 of flange inserts 1110, 1112, respectively, are flush with or recessed into an outside surface 1209 of the handguard 1205, in accordance with some embodiments.

Figure 21:
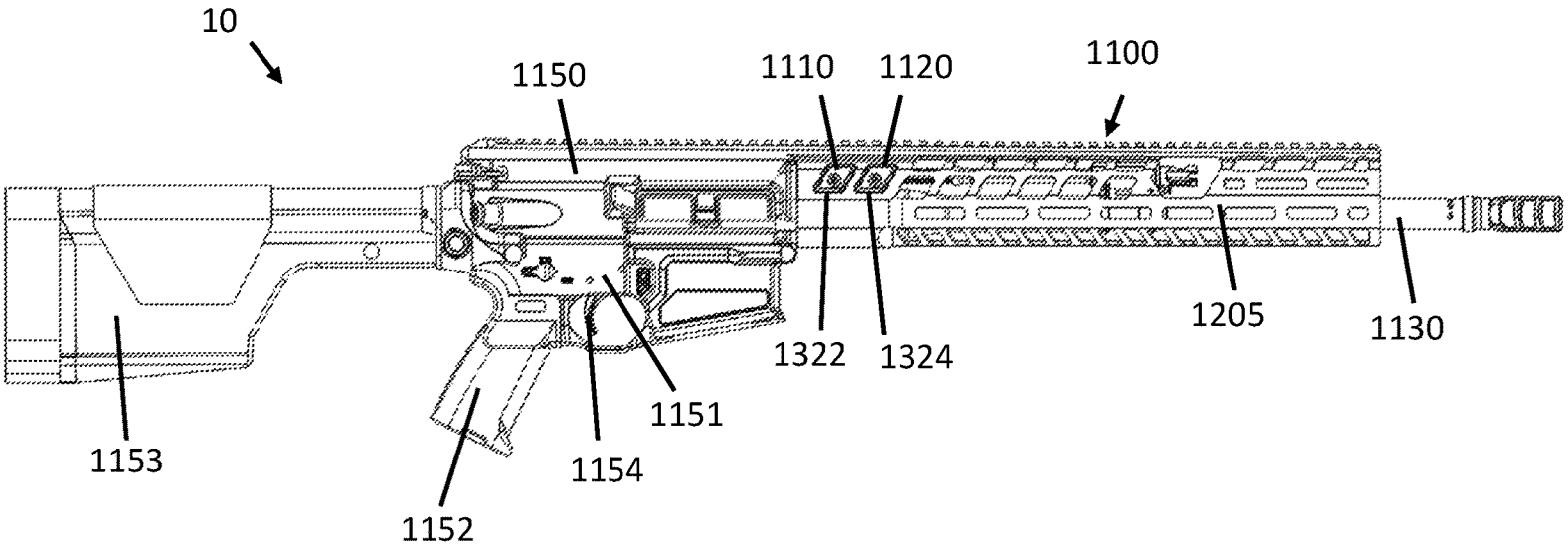
FIG. 21 illustrates a right-side view of an example firearm with a handguard attachment assembly installed thereon, in accordance with an embodiment of the present disclosure.

FIGS. 21 and 22 show right-side and left-side views, respectively, of an example firearm 10 with handguard assembly 1100 installed, in accordance with an embodiment of the present disclosure. The firearm 10 includes the upper receiver 1150 assembled with a lower receiver 1151. The handguard 1205 extends over the barrel 1130 and is secured to the upper receiver 1150 using the handguard assembly 1100 or 200. The lower receiver 1151 includes a grip 1152, stock 1153, and fire control assembly 1154, as will be appreciated. As shown in FIG. 21, for example, flange inserts 1110 and 1120 are installed in first and third lateral openings 1322 and 1324, respectively. As shown in FIG. 22, for example, flange inserts 1112 and 1122 are installed in second and fourth lateral openings 1323 and 1325, respectively.

Methodology

Figure 23:
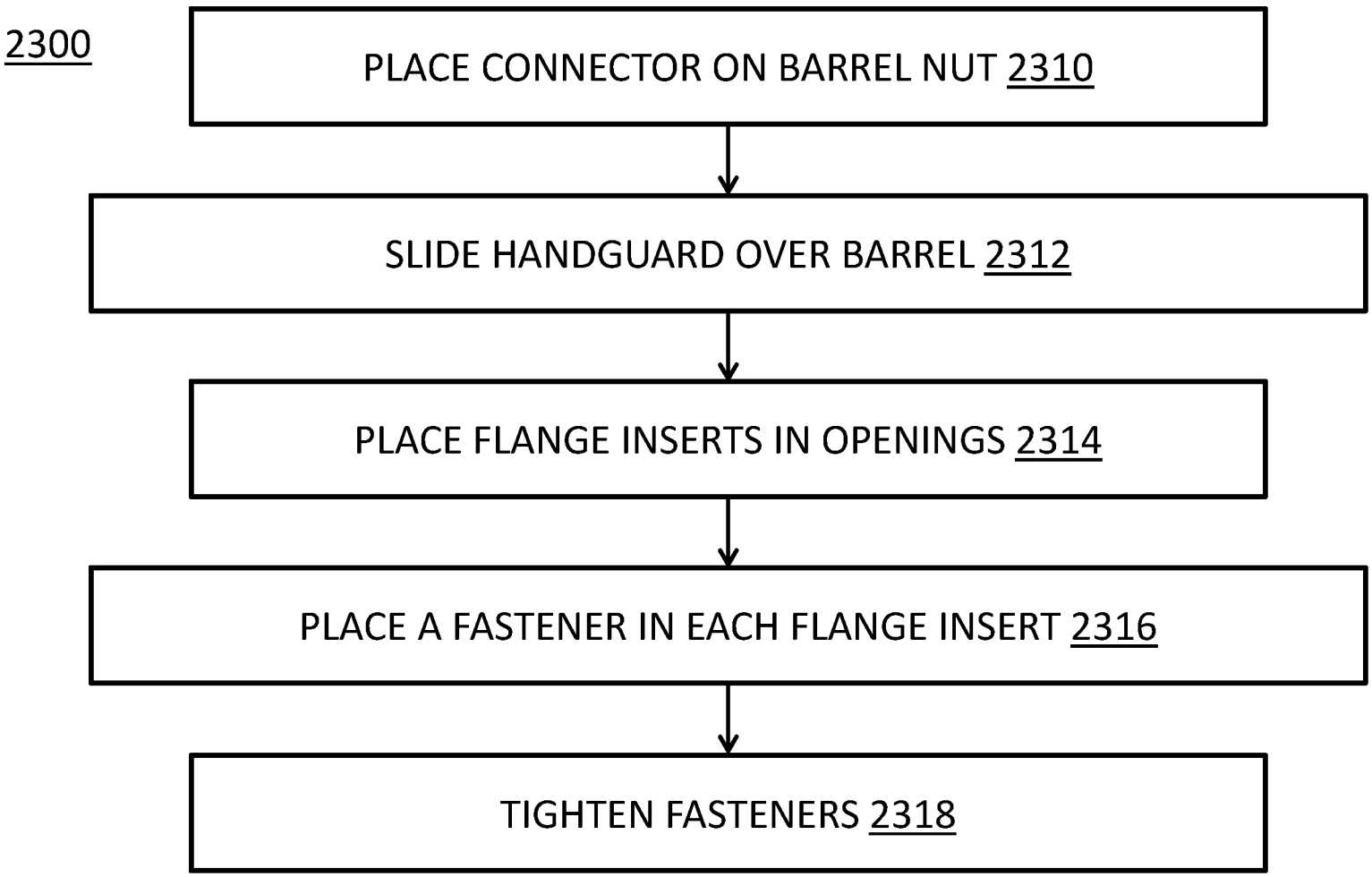
FIG. 23 illustrates a flowchart of a method for attaching a handguard to a firearm in accordance with an embodiment of the present disclosure.

FIG. 23 illustrates a flowchart of a method 2300 for attaching a handguard to a firearm in accordance with an embodiment of the present disclosure. In accordance with an embodiment, the method 2300 of attaching a handguard to a firearm includes 2310 placing a connector on the barrel nut. For example, the connector 1125 is placed on the barrel nut 1135. At 2312, the handguard is installed over the barrel of the firearm. It will be appreciated in light of the present disclosure that installing the handguard can include sliding the handguard over the gas block and positioning the proximal end portion over the barrel nut and/or upper receiver connector. At 2314, the flange inserts are placed in lateral openings on the handguard. For example, the flange insert 1110 is placed in first lateral opening 1322, and flange insert 1120 is placed in third lateral opening 1324. At 2316, a fastener is placed through each flange insert and positioned to engage the connector. At 2318, the fasteners are tightened (e.g., by threading into the connector) to secure the handguard to the firearm.

As will be appreciated in light of this disclosure, embodiments of the handguard assembly system may include additional, fewer, and/or different elements or components from those described herein, and the present disclosure is not intended to be limited to any particular configurations or arrangements of elements such as those variously described herein, but can be used with numerous configurations in numerous applications. Further, while in some embodiments, the handguard assembly systems can be configured as shown and described with respect to the various figures, the claimed invention is not so limited. Other suitable geometries, arrangements and configurations for various elements and components of the apparatus will depend on a given application and will be apparent in light of this disclosure.

Further Example Embodiments

The following examples pertain to further embodiments, from which numerous permutations and configurations will be apparent.

Example 1 is a handguard assembly for a firearm having an upper receiver, a barrel, and a gas block, the handguard assembly comprising: a handguard having an elongate tubular structure with a proximal end portion, the proximal end portion defining a first opening on a first side of the handguard and a second opening on an opposite second side of the handguard; a first flange insert having a first flange portion with a first inside face and a first boss portion protruding from the first inside face, the first flange insert defining a fastener opening therethrough and configured to be received in the first opening with the first inside face engaging the first side of the handguard; a second flange insert having a second flange portion with a second inside face and a second boss portion protruding from the second inside face, the second flange insert defining a fastener opening therethrough and configured to be received in the second opening with the second inside face engaging the second side of the handguard; a connector configured to be disposed within the proximal end portion of the handguard and in contact with the barrel nut, the connector defining a first fastener opening on a first side of the connector and a second fastener opening on an opposite second side of the connector; and fasteners constructed to extend through the fastener opening in the first flange insert or the second flange insert and to engage the first fastener opening or the second fastener opening in the connector; wherein, when the handguard is installed on the firerarm, the first flange insert is received in the first opening with the first flange portion engaging the first side of the handguard, the second flange insert is received in the second opening with the second flange portion engaging the second side of the handguard, one of the fasteners extends through the fastener opening in the first flange insert and engages the first fastener opening in the connector, and another of the fasteners extends through the fastener opening in the second flange insert and engages the second fastener opening in the connector.

Example 2 includes the subject matter of Example 1, wherein the firearm includes an operating rod and the connector defines a cavity that receives the operating rod therethrough when the handguard is installed on the firearm.

Example 3 includes the subject matter of any of Examples 1 or 2, wherein the proximal end portion of the handguard further defines a third opening on the first side of the handguard and a fourth opening on the second side of the handguard, the handguard assembly further comprising: a third flange insert having a third flange portion with a third inside face and a third boss portion protruding from the third inside face, the third flange insert defining a fastener opening therethrough and configured to be received in the third opening with the third inside face engaging the first side of the handguard; a fourth flange insert having a fourth flange portion with a fourth inside face and a fourth boss portion protruding from the fourth inside face, the fourth flange insert defining a fastener opening therethrough and configured to be received in the fourth opening with the fourth inside face engaging the second side of the handguard; a third fastener configured to secure the third flange insert to the connector when the handguard is installed on the firearm; and a fourth fastener configured to secure the fourth flange insert to the connector when the handguard is installed on the firearm.

Example 4 includes the subject matter of any of Examples 1-3, wherein the connector includes a body portion defining a cavity axially therethrough, the cavity sized to accommodate an operating rod or a gas tube of the firearm.

Example 5 includes the subject matter of Example 4, wherein the connector further includes a first lug connected to the body portion and a second lug connected to the body portion opposite the first lug, the first lug defining the first fastener opening and the second lug defining the second fastener opening.

Example 6 includes the subject matter of Example 5, wherein the first boss portion receives the first lug and a second boss portion receives the second lug when the handguard is installed on the firearm. For example, the first lug engages an inside surface of the sidewalls of the first boss portion of a first flange insert and the second lug engages an inside surface of the sidewalls of the second boss portion of a second flange insert.

Example 7 includes the subject matter of any of Examples 1-6, wherein the connector has an arced surface that interfaces with an outside surface of the barrel nut when the handguard is installed on the firearm.

Example 8 includes the subject matter of Example 7, wherein the arced surface is received in a circumferential slot in the barrel nut.

Example 9 is a handguard assembly for a firearm having an upper receiver and a barrel secured to the upper receiver with a barrel nut, the handguard assembly comprising: a handguard having an elongate tubular structure with a first side, a second side opposite the first side, and a proximal end portion, wherein the proximal end portion defines a first opening through the first side of the handguard; a first flange insert having a flange portion with an inside face and a boss portion protruding from the inside face, the first flange insert defining a fastener opening therethrough and configured to be installed in the handguard with the boss portion received in the first opening and the first inside face engaging an outside surface of the handguard; a connector configured to be disposed within the proximal end portion between the handguard and the barrel nut, the connector defining a first fastener opening; and a first fastener configured to extend through the fastener opening in the first flange insert and engage the first fastener opening in the connector when the handguard is installed on the firearm; wherein advancing the first fastener into the first fastener opening draws the first side of the handguard towards the connector and draws the proximal end portion towards the barrel nut when the handguard is installed on the firearm.

Example 10 includes the subject matter of Example 9, wherein the connector includes a first connector end portion configured to engage the second side of the handguard and a second connector end portion defining the first fastener opening, wherein the connector extends transversely over the barrel nut between the first side and the second side of the handguard when the handguard assembly is installed on the firearm.

Example 11 includes the subject matter of Example 9 or 10, wherein advancing the first fastener into the first fastener opening draws a bottom of the proximal end portion upward towards the barrel nut when the handguard is installed on the firearm.

Example 13 includes the subject matter of any of Examples 9-11, wherein the connector defines an arced bottom surface configured to mate with an outside surface of the barrel nut when the handguard is installed on the firearm.

Example 14 includes the subject matter of Example 9, wherein the proximal end portion of the handguard defines a second opening, the handguard assembly further comprising: a second flange insert having a second flange portion with a second inside face and a second boss portion protruding from the second inside face of the second flange portion, the second boss portion received in the second opening and the second inside face engaging the outside surface of the handguard when the handguard is installed on the firearm; and a second fastener extending through the second flange insert and engaging the connector to secure the second flange insert to the connector when the handguard is installed on the firearm.

Example 15 includes the subject matter of any of Examples 9-14, wherein the firearm includes a gas block on the barrel and an operating rod extending between the gas block and the upper receiver, and wherein the connector defines an axial through-opening sized and configured to receive the operating rod therethrough when the handguard is installed on the firearm.

Example 16 includes the subject matter of Example 9, wherein the firearm includes a gas block on the barrel and an operating rod extending between the gas block and the upper receiver, and wherein the connector defines an axial through-opening sized and configured to receive the operating rod therethrough when the handguard is installed on the firearm.

Example 17 includes the subject matter of Example 16, wherein the connector defines an arced bottom surface configured to mate with the barrel nut when the handguard is installed on the firearm.

Example 18 includes the subject matter of Examples 9 or 16, wherein the connector comprises: a connector body; a first lug on a first side of the connector body, the first lug defining the first fastener opening; and a second lug on an opposite second side of the connector body, the second lug defining a second fastener opening, wherein the second fastener engages the second fastener opening when the handguard is installed on the firearm.

Example 19 includes the subject matter of Example 18, wherein the connector defines an arced bottom surface configured to mate with the barrel nut when the handguard is installed on the firearm, the arced bottom surface extending along a bottom of the first lug and the second lug.

Example 20 is a handguard assembly for attachment to a firearm having an upper receiver, a barrel with a barrel nut, and a gas block, the handguard assembly comprising: a handguard with an elongate perforated structure extending between a first end and a second end, the handguard having a first opening proximate the first end; a clamp comprising a first clamp portion and a second clamp portion; and a fastener extending between and securing the first clamp portion to the second clamp portion when the handguard is installed on the firearm; wherein the first clamp portion extends through the first opening when the handguard is installed on the firearm.

Example 21 includes the subject matter of Example 20, wherein the fastener comprises a screw.

Example 22 includes the subject matter of Example 21, wherein the first clamp portion includes a threaded portion to engage the screw when the handguard is installed on the firearm.

Example 23 includes the subject matter of any of Examples 20-22, wherein the second clamp portion defines a flange having an inside face that is configured to contact an outside surface of the handguard proximate the first end when the handguard is installed on the firearm.

Example 24 includes the subject matter of Example 23, wherein tightening the fastener between the first clamp portion and the second clamp portion draws opposite sides the handguard inward when the handguard is installed on the firearm.

Example 25 includes the subject matter of any of Examples 20-24, wherein the second clamp portion is configured to be installed in a second opening opposite the first opening.

Example 26 includes the subject matter of any of Examples 20-25, wherein the second clamp portion includes a boss portion that is received in the second opening, the boss portion configured to bear against the handguard when the handguard is installed on the firearm.

Example 27 includes the subject matter of Example 26, wherein the second clamp portion further includes a flange portion connected to the boss portion, the flange portion configured to engage an outside surface of the handguard when the handguard is installed on the firearm.

Example 28 includes the subject matter of any of Examples 26 or 27, wherein the boss portion is configured to draw the handguard upward against the barrel nut when the handguard is installed on the firearm.

Example 29 includes the subject matter of any of Examples 20-28, wherein the first clamp portion includes an arced bottom surface that is configured to interface with the barrel nut when the handguard is installed on the firearm.

Example 30 includes the subject matter of Example 29, wherein the arced bottom surface is configured to engage a top of the barrel nut when the handguard is installed on the firearm.

Example 31 includes the subject matter of any of Examples 20-30, wherein the firearm further includes an operating rod or gas tube extending between the gas block and the upper receiver, and wherein the first clamp portion defines a through-opening sized and configured to receive the operating rod or gas tube therethrough when the handguard is installed on the firearm.

Example 32 is a firearm comprising the handguard assembly of any of claims 1-31, wherein the handguard is installed on the firearm.

Example 33 is a clamp for securing a handguard to a firearm having an upper receiver, a barrel secured to the upper receiver, a gas block on the barrel, and an operating rod extending between the gas block and the upper receiver, the clamp comprising: a first clamp portion that extends through a first hole on a first side of the handguard when the handguard is installed on the firearm; a second clamp portion received through a second hole in a second side of the handguard when the handguard is installed on the firearm, the second clamp portion engaging a second side of the handguard adjacent the second hole, wherein the second clamp portion is aligned along a common axis with the first clamp portion when the handguard is installed on the firearm; and a fastener that extends between and secures the first clamp portion to the second clamp portion of the clamp when the handguard is installed on the firearm.

Example 34 includes the subject matter of Example 33, wherein the fastener comprises a screw.

Example 35 includes the subject matter of Example 34, wherein the first clamp portion defines a threaded bore to engage the screw when the handguard is installed on the firearm.

Example 36 includes the subject matter of any of Examples 33-35, wherein the second clamp portion defines a flange portion having an inside face that is configured to contact an outside surface of the handguard proximate the first end when the handguard is installed on the firearm.

Example 37 includes the subject matter of Example 36, wherein the second clamp portion includes a boss portion protruding from the inside face of the flange portion, the boss portion configured to bear against the handguard when the handguard is installed on the firearm.

Example 38 includes the subject matter of Example 36, wherein the first clamp portion includes a clamp body connected to and extending from the boss portion away from the flange portion.

Example 39 includes the subject matter of Example 38, wherein the clamp body defines an opening sized to receive the operating rod therethrough when the handguard is installed on the firearm.

Example 40 includes the subject matter of Example 33-39 and further comprises the handguard having an elongate tubular structure with a proximal end portion that defines the first hole on the first side and the second hole on the second side.

Example 41 includes the subject matter of Example 40 and further comprises a firearm upper receiver with a barrel secured thereto with a barrel nut, wherein the handguard is installed on the firearm upper receiver with the proximal end portion of the handguard overlapping the barrel nut.

Example 42 is a handguard assembly for a firearm with an upper receiver and a barrel secured to the upper receiver with a barrel nut, the handguard assembly comprising: a handguard removably attachable to the upper receiver of the firearm, the handguard including at least a first opening on a first side of the handguard and a second opening on a second side of the handguard opposite the first side; and a clamp configured to secure the handguard to the firearm to the upper receiver of the firearm via the first opening and the second opening; wherein the clamp is configured to engage the barrel nut when the handguard is installed on the firearm.

Example 43 includes the subject matter of Example 42, wherein the clamp comprises a first clamp portion that extends through the first opening and a second clamp portion that extends through the second opening when the handguard is installed on the firearm.

Example 44 includes the subject matter of Example 43, further comprising a fastener secured through the second opening, wherein the fastener is configured to secure the first clamp portion to the second clamp portion.

Example 45 includes the subject matter of any of Examples 42-44, wherein the fastener comprises a screw.

Example 46 includes the subject matter of any of Examples 42-45, wherein the second clamp portion defines a flange portion having an inside face and a boss portion protruding from the inside face of the flange portion, wherein the boss portion is configured to be received in the second opening with the inside face in contact with an outside of the handguard when the handguard is installed on the firearm.

Example 47 includes the subject matter of any of Example 42-46, wherein the clamp includes an arced surface on a bottom surface of the clamp that is configured to interface with the barrel nut when the handguard is installed on the firearm.

Example 48 includes the subject matter of Example 47, wherein the arced surface is configured to contact a top of the barrel nut when the handguard is installed on the firearm.

Example 49 includes the subject matter of Example 48, wherein the firearm further includes a gas block and an operating rod or a gas tube extending between the gas block and the upper receiver, and wherein the clamp defines a cavity sized and configured to receive the operating rod or gas tube therethrough when the handguard is installed on the firearm.

Example 50 is a firearm comprising the handguard assembly of any of Examples 42-49, wherein the handguard is installed on the firearm.

Example 51 is a firearm upper receiver assembly comprising: an upper receiver with a barrel secured to the upper receiver with a barrel nut; a handguard having an elongate tubular structure with a first side, a second side opposite the first side, and a proximal end portion, the handguard extending over the barrel with the proximal end portion overlapping the barrel nut, wherein the proximal end portion defines a first opening through the first side of the handguard; a first flange insert defining a fastener opening therethrough and having a flange portion with an inside face and a boss portion protruding from the inside face, wherein the first flange insert is installed in the handguard with the boss portion received in the first opening and the inside face engaging an outside surface of the first side of the handguard; a connector disposed within the proximal end portion between the handguard and the barrel nut, the connector defining a first fastener opening; and a first fastener extending through the fastener opening in the first flange insert and into the first fastener opening in the connector, thereby securing the first flange insert to the connector; wherein tightening the first fastener draws the first side of the handguard towards the connector.

Example 52 includes the subject matter of Example 51, wherein the connector comprises a flange portion with an inside face in contact with an outside of the second side of the handguard; and a connector body extending from the flange portion over the barrel nut to an end portion defining the first fastener opening.

Example 53 includes the subject matter of Example 52, wherein the connector defines an arced surface engaging an outside surface of the barrel nut.

Example 54 includes the subject matter of Example 51, wherein the proximal end portion of the handguard defines a second opening, and the handguard assembly further comprising a second flange insert defining a second fastener opening therethrough and having a second flange portion with a second inside face and a second boss portion protruding from the second inside face, wherein the second flange insert is installed in the handguard with the second boss portion received in the second opening and the second inside face engaging an outside surface of the second side of the handguard; and a second fastener extending through the second fastener opening and engaging a second fastener opening defined in the connector to secure the second flange insert to the connector.

Example 55 includes the subject matter of Example 54 and further comprises a gas block on the barrel; and an operating rod extending between the gas block and the upper receiver; wherein the connector defines an axial through-opening with the operating rod extending therethrough.

Example 56 includes the subject matter of Example 54 or 55, wherein the connector comprises a connector body defining the axial through-opening; a first lug on a first side of the connector body, the first lug defining the first fastener opening; and a second lug on an opposite second side of the connector body, the second lug defining the second fastener opening.

Example 57 includes the subject matter of Example 56, wherein the first lug is received in a recess defined in the boss portion of the first flange insert and wherein the second lug is received in a second recess defined in the boss portion of the second flange insert.

Example 58 includes the subject matter of Example 57, wherein each of the first lug and the second lug engage a sidewall of the boss portion of the first flange insert and the second insert, respectively. For example, the first and second lugs are received between and engage an inside surface of the sidewall of the respective boss portion when the handguard is installed on the upper receiver.

Example 59 includes the subject matter of any of Examples 55-58, wherein the connector defines an arced bottom surface in contact with the barrel nut.

Example 60 includes the subject matter of Example 59, wherein the arced bottom surface includes a bottom of the first lug and a bottom of the second lug.

Example 61 includes the subject matter of any of Examples 59-60, wherein the arced bottom surface is received in a circumferential groove defined in an outside of the barrel nut.

Example 62 includes the subject matter of any of Examples 54-61, wherein the flange portion of the first flange insert and a corresponding surface of the upper portion of the handguard are inclined with respect a horizontal; the flange portion of the second flange insert and a second corresponding surface of the upper portion of the handguard are inclined with respect a horizontal: and tightening the first fastener and the second fastener imparts an upward force on the handguard.

Example 63 includes the subject matter of any of Examples 51-62 and further comprises a lower receiver assembled to the upper receiver, the lower receiver including a fire control assembly.

Example 64 is a method of attaching a handguard to a firearm having an upper receiver, and a barrel secured to the upper receiver with a barrel nut, the method comprising: placing a connector on the barrel nut; sliding a handguard over the barrel nut and the connector; placing a first flange insert in a first opening on a first side of the handguard; placing a second flange insert in a second opening on an opposite second side of the handguard; placing a first fastener to extend through the first flange insert and to engage the connector; placing a second fastener to extend through the second flange insert and to engage the connector; tightening the first fastener to draw the first flange towards the connector; and tightening the second fastener to draw the second flange towards the connector.

Example 65 includes the subject matter of Example 64, and further comprises, after sliding the handguard over the barrel nut and the connector and prior to tightening the first fastener, placing a third flange insert in a third opening on the first side of the handguard; placing a fourth flange insert in a fourth opening on the opposite second side of the handguard; placing a third fastener to extend through the third flange insert and to engage the connector; placing a fourth fastener to extend through the fourth flange insert and to engage the connector; tightening the third fastener to draw the third flange towards the connector; and tightening the fourth fastener to draw the fourth flange towards the connector.

Example 66 is a method of attaching a handguard to a firearm having an upper receiver and a barrel secured to the upper receiver with a barrel nut, the method comprising placing the handguard over the barrel of the firearm with a proximal end portion of the handguard over the barrel nut; placing a first clamp portion of a first clamp through a first hole in the handguard, part of the first clamp portion engaging an outside of the handguard; placing a second clamp portion of the first clamp through a second hole opposite the first hole, part of the second portion of the first clamp engaging an outside of the handguard; placing a fastener through the second clamp portion and engaging the first clamp portion; and tightening the fastener to draw together the first clamp portion and the second clamp portion.

Example 67 includes the subject matter of Example 66 and further comprises placing a first clamp portion of a second clamp through a third hole in the handguard, part of the first clamp portion of the second clamp engaging an outside of the handguard; placing a second clamp portion of the second clamp through a fourth hole opposite the third hole, part of the second clamp portion of the second clamp engaging an outside of the handguard; connecting a second fastener between the first clamp portion and the second clamp portion of the second clamp; and tightening the second fastening to draw together the first clamp portion and the second clamp portion of the second clamp.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Subsequent applications claiming priority to this application may claim the disclosed subject matter in a different manner and generally may include any set of one or more limitations as variously disclosed or otherwise demonstrated herein.

What is claimed is:

1. A handguard assembly for a firearm having an upper receiver, a barrel and barrel nut, and a gas block, the handguard assembly comprising:

a handguard having an elongate tubular structure with a proximal end portion, the proximal end portion defining a first opening on a first side of the handguard and a second opening on an opposite second side of the handguard;

a first flange insert having a first flange portion with a first inside face and a first boss portion protruding from the first inside face, the first flange insert defining a fastener opening therethrough and the first boss portion configured to be received in the first opening with the first inside face engaging the first side of the handguard;

a second flange insert having a second flange portion with a second inside face and a second boss portion protruding from the second inside face, the second flange insert defining a fastener opening therethrough and the second boss portion configured to be received in the second opening with the second inside face engaging the second side of the handguard;

a connector configured to be disposed within the proximal end portion of the handguard and in contact with the barrel nut, the connector defining a first fastener opening on a first side of the connector and a second fastener opening on an opposite second side of the connector; and fasteners constructed to extend through the fastener opening in the first flange insert or the second flange insert and to engage the first fastener opening or the second fastener opening in the connector;

wherein, when the handguard is installed on the firearm, the first flange insert is received in the first opening with the first flange portion engaging the first side of the handguard, the second flange insert is received in the second opening with the second flange portion engaging the second side of the handguard, one of the fasteners extends through the fastener opening in the first flange insert and engages the first fastener opening in the connector, and another of the fasteners extends through the fastener opening in the second flange insert and engages the second fastener opening in the connector.

2. The handguard assembly of claim 1, wherein the firearm includes an operating rod and the connector defines a cavity that receives the operating rod therethrough when the handguard is installed on the firearm.

3. The handguard assembly of claim 1, wherein the proximal end portion of the handguard further defines a third opening on the first side of the handguard and a fourth opening on the second side of the handguard, the handguard assembly further comprising:

a third flange insert having a third flange portion with a third inside face and a third boss portion protruding from the third inside face, the third flange insert defining a fastener opening therethrough and configured to be received in the third opening with the third inside face engaging the first side of the handguard;

a fourth flange insert having a fourth flange portion with a fourth inside face and a fourth boss portion protruding from the fourth inside face, the fourth flange insert defining a fastener opening therethrough and configured to be received in the fourth opening with the fourth inside face engaging the second side of the handguard;

a third fastener configured to secure the third flange insert to the connector when the handguard is installed on the firearm; and a fourth fastener configured to secure the fourth flange insert to the connector when the handguard is installed on the firearm.

4. The handguard assembly of claim 1, wherein the connector includes a body portion defining a cavity axially therethrough, the cavity sized to accommodate an operating rod or a gas tube of the firearm.

5. The handguard assembly of claim 4, wherein the connector further includes a first lug connected to the body portion and a second lug connected to the body portion opposite the first lug, the first lug defining the first fastener opening and the second lug defining the second fastener opening.

6. The handguard assembly of claim 1, wherein the first boss portion receives the first lug and the second boss portion receives the second lug when the handguard is installed on the firearm.

7. The handguard assembly of claim 1, wherein the connector has an arced surface that interfaces with an outside surface of the barrel nut when the handguard is installed on the firearm.

8. The handguard assembly of claim 7, wherein the arced surface is received in a circumferential slot in the barrel nut.

9. A handguard assembly for a firearm having an upper receiver and a barrel with a barrel nut, the handguard assembly comprising:

a handguard having an elongate tubular structure with a first side, a second side opposite the first side, and a proximal end portion, wherein the proximal end portion defines a first opening through the first side of the handguard;

a first flange insert having a flange portion with an inside face and a boss portion protruding from the inside face, the first flange insert defining a fastener opening therethrough and configured to be installed in the handguard with the boss portion received in the first opening and the first inside face engaging an outside surface of the handguard;

a connector configured to be disposed within the proximal end portion between the handguard and the barrel nut, the connector defining a first fastener opening and the connector having a bottom surface configured to contact the barrel nut when the handguard is installed on the firearm; and a first fastener configured to extend through the fastener opening in the first flange insert and engage the first fastener opening in the connector when the handguard is installed on the firearm;

wherein advancing the first fastener into the first fastener opening draws the first side of the handguard towards the connector and draws the proximal end portion towards the barrel nut when the handguard is installed on the firearm.

10. The handguard assembly of claim 9, wherein the connector includes a first connector end portion configured to engage the second side of the handguard and a second connector end portion defining the first fastener opening, wherein the connector extends transversely over the barrel nut between the first side and the second side of the handguard when the handguard assembly is installed on the firearm.

11. The handguard assembly of claim 10, wherein advancing the first fastener into the first fastener opening draws a bottom of the proximal end portion upward towards the barrel nut when the handguard is installed on the firearm.

12. The handguard assembly of claim 10, wherein the connector defines an arced bottom surface configured to mate with an outside surface of the barrel nut when the handguard is installed on the firearm.

13. The handguard assembly of claim 9, wherein the proximal end portion of the handguard defines a second opening, the handguard assembly further comprising:

a second flange insert having a second flange portion with a second inside face and a second boss portion protruding from the second inside face of the second flange portion, the second boss portion received in the second opening and the second inside face engaging the outside surface of the handguard when the handguard is installed on the firearm; and a second fastener extending through the second flange insert and engaging the connector to secure the second flange insert to the connector when the handguard is installed on the firearm.

14. The handguard assembly of claim 9, wherein the firearm includes a gas block on the barrel and an operating rod extending between the gas block and the upper receiver, and wherein the connector defines an axial through-opening sized and configured to receive the operating rod therethrough when the handguard is installed on the firearm.

15. The handguard assembly of claim 14, wherein the connector comprises:

a connector body;

a first lug on a first side of the connector body, the first lug defining the first fastener opening; and a second lug on an opposite second side of the connector body, the second lug defining a second fastener opening, wherein the second fastener engages the second fastener opening when the handguard is installed on the firearm.

16. The handguard assembly of claim 15, wherein the bottom surface is an arced surface extending along a bottom of the first lug and the second lug.

17. A firearm upper receiver assembly comprising:

an upper receiver with a barrel secured to the upper receiver with a barrel nut;

a handguard having an elongate tubular structure with an upper portion, a lower portion, a first side, a second side opposite the first side, and a proximal end portion, the handguard extending over the barrel with the proximal end portion overlapping the barrel nut, wherein the proximal end portion defines a first opening through the first side of the upper portion of the handguard;

a first flange insert defining a fastener opening therethrough and having a flange portion with an inside face and a boss portion protruding from the inside face, wherein the first flange insert is installed in the handguard with the boss portion received in the first opening and the inside face engaging an outside surface of the first side of the upper portion of the handguard;

a connector disposed within the proximal end portion between the handguard and the barrel nut, the connector defining a first fastener opening and having a bottom surface engaging an outside surface of the barrel nut; and a first fastener extending through the fastener opening in the first flange insert and into the first fastener opening in the connector, thereby securing the first flange insert to the connector.

18. The firearm upper receiver assembly of claim 17, wherein the connector comprises:

a flange portion with an inside face in contact with an outside of the second side of the handguard; and a connector body extending from the flange portion over the barrel nut to an end portion defining the first fastener opening.

19. The firearm upper receiver assembly of claim 18, wherein the bottom surface is arced.

20. The firearm upper receiver assembly of claim 17, wherein the proximal end portion of the handguard defines a second opening through the second side of the upper portion of the handguard, and the handguard assembly further comprising:

a second flange insert defining a second fastener opening therethrough and having a second flange portion with a second inside face and a second boss portion protruding from the second inside face, wherein the second flange insert is installed in the handguard with the second boss portion received in the second opening and the second inside face engaging an outside surface of the second side of the handguard; and a second fastener extending through the second fastener opening and engaging a second fastener opening defined in the connector to secure the second flange insert to the connector.

21. The firearm upper receiver assembly of claim 20 further comprising:

a gas block on the barrel; and an operating rod extending between the gas block and the upper receiver;

wherein the connector defines an axial through-opening with the operating rod extending therethrough.

22. The firearm upper receiver assembly of claim 21, wherein the connector comprises:

a connector body defining the axial through-opening;

a first lug on a first side of the connector body, the first lug defining the first fastener opening; and a second lug on an opposite second side of the connector body, the second lug defining the second fastener opening.

23. The firearm upper receiver assembly of claim 22, wherein the connector defines an arced bottom surface in contact with the barrel nut, the arced bottom surface including a bottom of the first lug and a bottom of the second lug.

24. The firearm upper receiver assembly of claim 23, wherein the arced bottom surface is received in a circumferential groove defined in an outside of the barrel nut.

25. The firearm upper receiver assembly of claim 20, wherein:

the flange portion of the first flange insert and a corresponding surface of the upper portion of the handguard are inclined with respect a horizontal;

the flange portion of the second flange insert and a second corresponding surface of the upper portion of the handguard are inclined with respect the horizontal; and tightening the first fastener and/or the second fastener imparts an upward force on the handguard.

26. The firearm upper receiver assembly of claim 20, wherein the first fastener and the second fastener extend horizontally.

* * * * *